US008009122B2

(12) United States Patent
Yamamoto et al.

(10) Patent No.: US 8,009,122 B2
(45) Date of Patent: Aug. 30, 2011

(54) PLASMA DISPLAY DEVICE

(75) Inventors: Kenichi Yamamoto, Higashimurayama (JP); Keizo Suzuki, Kodaira (JP)

(73) Assignee: Hiachi, Ltd., Tokyo (JP)

( * ) Notice: Subject to any disclaimer, the term of this patent is extended or adjusted under 35 U.S.C. 154(b) by 1399 days.

(21) Appl. No.: 11/513,361

(22) Filed: Aug. 31, 2006

(65) Prior Publication Data

US 2007/0229399 A1 Oct. 4, 2007

(30) Foreign Application Priority Data

Mar. 30, 2006 (JP) ..... 2006-093601

(51) Int. Cl.
*G09G 3/26* (2006.01)

(52) U.S. Cl. ..... 345/60; 345/63; 345/55

(58) Field of Classification Search ..... 345/60, 345/63, 55

See application file for complete search history.

(56) References Cited

U.S. PATENT DOCUMENTS

| | | | | |
|---|---|---|---|---|
| 6,335,712 | B1 * | 1/2002 | Kim | 345/60 |
| 6,714,176 | B2 | 3/2004 | Yamamoto et al. | |
| 2003/0090206 | A1 | 5/2003 | Uemura et al. | |
| 2004/0257304 | A1 | 12/2004 | Yamamoto et al. | |
| 2005/0062418 | A1 | 3/2005 | Kang et al. | |
| 2005/0212725 | A1 | 9/2005 | Sasaki et al. | |

FOREIGN PATENT DOCUMENTS

| | | |
|---|---|---|
| CN | 1573856 | 2/2005 |
| CN | 1617288 | 5/2005 |
| JP | 2003-151446 | 5/2003 |
| JP | 2004-071367 | 3/2004 |

* cited by examiner

*Primary Examiner* — Richard Hjerpe
*Assistant Examiner* — Leonid Shapiro
(74) *Attorney, Agent, or Firm* — Antonelli, Terry, Stout & Kraus, LLP.

(57) ABSTRACT

A plasma display device includes a plasma display panel provided with plural discharge cells each having discharge gas, a pair of sustain electrodes which generate sustain discharge, and a phosphor, and a driving circuit which applies a sustain pulse voltage between the pair of sustain electrodes for generating the sustain discharge. The sustain pulse voltage is formed of a first portion having a main portion of a first voltage Vp and a second portion succeeding the first portion in time and having a main portion of a second voltage Vs higher than the first voltage Vp, the sustain discharge is formed of a pre-discharge and a main discharge succeeding the pre-discharge in time, and the first voltage Vp is selected to satisfy Vpmin≦Vp<Vs, where Vpmin is a minimum of the first voltage Vp which stabilizes the sustain discharge.

19 Claims, 26 Drawing Sheets

PLASMA DISPLAY DEVICE

CLAIM OF PRIORITY

The present application claims priority from Japanese application JP 2006-093601, filed on Mar. 30, 2006, the content of which is hereby incorporated by reference into this application.

BACKGROUND OF THE INVENTION

The present invention relates to a plasma display device employing a plasma display panel (hereinafter referred to as a PDP) and a method of driving the PDP. The present invention is useful for improving luminous efficacy of the PDP and suppressing deterioration of protective films within the PDP with operating time of the PDP.

Now, as plasma TV (PDP-TV) receivers, which are one kind of plasma display devices employing a plasma display panel (PDP), are establishing themselves in the market of thin, large-screen TV receivers, they are competing fiercely against competitive devices such as liquid crystal display devices and others.

FIG. 10 is an exploded perspective view of an example of a conventional ac surface-discharge type PDP employing a three-electrode structure. In the ac surface-discharge type PDP shown in FIG. 10, a discharge space 63 is formed between a pair of opposing glass substrates, a front substrate 51 and a rear substrate 58. Usually the discharge space 63 is filled with a discharge gas at several hundreds or more of Torr. As the discharge gas, usually He, Ne, Xe, and Ar are used either alone or in combination with one or more of the others.

A plurality of sustain electrode pairs of X and Y electrodes which generate discharge mainly for display light emission are disposed on the underside of the front substrate 51 serving as a display screen.

Usually, each of the X and Y electrodes is made of a combination of a transparent electrode and an opaque electrode for supplementing conductivity of the transparent electrode.

The X electrodes 64 are comprised of transparent X electrodes 52-1, 52-2, . . . and corresponding opaque X bus electrodes 54-1, 54-2, . . . , respectively, and the Y electrodes 65 are comprised of transparent Y electrodes 53-1, 53-2, . . . and corresponding opaque Y bus electrodes 55-1, 55-2, . . . , respectively. It is often that the X electrodes are used as a common electrode and the Y electrodes are used as independent electrodes. Usually a discharge gap (also called a slit or a regular slit) Ldg between the X and Y electrodes in one discharge cell is designed to be small such that a discharge start voltage is not excessively high, and a spacing (also called a reverse slit) Lng between an X electrode in one cell and a Y electrode in another cell adjacent to the one cell is designed to be large such that unwanted discharge is prevented from occurring between two adjacent cells.

The X and Y sustain electrodes 64, 65 are covered with a front dielectric substance 56, a surface of which, in turn, is covered with a protective film 57 made of material such as magnesium oxide (MgO) or the like.

The MgO protects the front dielectric substance 56 and lowers a firing voltage because of its higher sputtering resistance and higher secondary electron emission yield, compared with other materials.

Address electrodes (also called A electrodes) 59 for addressing cells and thereby generating address-discharge are arranged on the upper surface of the rear substrate 58 in a direction perpendicular to the sustain electrodes (X and Y electrodes). The A electrodes 59 are covered with a rear dielectric substance 60. Ribs 61 are disposed between adjacent A electrodes 59 on the rear dielectric substance 60. A phosphor 62 is coated in a cavity formed by the wall surfaces of the ribs 61 and the upper surface of the rear dielectric substance 60.

In this configuration, each of intersections of the sustain electrode pairs with the A electrodes corresponds to one discharge cell, and the discharge cells are arranged in a two-dimensional fashion. In a color PDP, a trio comprised of three kinds of discharge cells coated with red, green and blue phosphors, respectively, forms one pixel.

FIG. 11 and FIG. 12 are cross-sectional views of one discharge cell shown in FIG. 10 viewed in the directions of the arrows D1 and D2, respectively. In FIG. 12, the boundary of the cell is approximately indicated by broken lines. In FIG. 12, reference numeral 66 denote electrons, 67 is a positive ion, 68 is a positive wall charge, and 69 are negative wall charges.

Next operation of the PDP of this example will be explained.

The principle of generation of light by the PDP is such that discharge is started by a voltage pulse applied between the X and Y electrodes, and then ultraviolet rays generated by excited discharge gases are converted into visible light by the phosphor.

FIG. 13 is a block diagram illustrating a basic configuration of a plasma display device 100. The PDP (also called the plasma display panel or the panel) 91 is incorporated into the plasma display device 100. The PDP 91 is coupled to a driving circuit 98 which is comprised of an X driving circuit 95, a Y driving circuit 96 and an A driving circuit 97 for supplying required voltages to the X, Y and A electrodes, respectively, via an X electrode terminal portion 92, a Y electrode terminal portion 93 and an A electrode terminal portion 94 which serve as connecting portions between electrode groups within the panel and external circuits.

The driving circuit 98 receives signals for a display image from a video signal source 99, converts the signals into driving voltages, and then supplies them to respective electrodes of the PDP 91. Illustrated in FIGS. 14(*a*)-14(*c*) are concrete examples of the driving voltages in a case where the ADS (Address Display-Period Separation) scheme is employed for producing gray scale levels.

FIG. 14(*a*) is a time chart illustrating a driving voltage during one TV field required for displaying one picture on the PDP shown in FIG. 10. FIG. 14(*b*) illustrates waveforms of voltages applied to the A electrode 59, the X electrode 64 and the Y electrode 65 during the address period 80 shown in FIG. 14(*a*). The X electrode and the Y electrodes are called the sustain electrodes, and a pair of an X electrode and a Y electrode is called a sustain electrode pair. FIG. 14(*c*) illustrates sustain pulse voltages (also called sustain voltages or sustain pulses) applied to the X and Y electrodes, which are the sustain electrodes, all at the same time, and a voltage (an address voltage) applied to the address electrodes all at the same time, during the sustain period 81 shown in FIG. 14(*a*).

Portion I of FIG. 11(*a*) illustrates that one TV field 70 is divided into sub-fields 71 to 78 having different plural numbers of light emission from one another. Gray scales are generated by a combination of one or more selected from among the plural sub-fields.

Suppose the eight sub-fields are provided which have different gray scale brightness steps in binary number step increments, then each discharge cell of a three-primary color display device provides $2^8$ (=256) gray scales, and as a result the three-primary color display device is capable of displaying about 16.78 millions of different colors.

Portion II of FIG. 14(*a*) illustrates that each sub-field comprises a reset period 79 for resetting the discharge cells to an initial state, an address period 80 for addressing discharge cells to be lighted, and a sustain period 81 for causing the addressed discharge cells to generate light.

FIG. 14(*b*) illustrates voltage waveforms (sustain pulse voltage waveforms) applied to the A electrode 59, the X electrode 64 and the Y electrode 65 during the address period 80 shown in FIG. 14(*a*). A waveform 82 represents a waveform (an A waveform) of a voltage V0 V applied to one of the A electrodes 59 during the address period 80, a waveform 83 represents a waveform (an X waveform) of a voltage V1 V applied to the X electrode 64, and waveforms 84 and 85 represent waveforms (Y waveforms) of voltages V21 V and V22 V applied to ith and (i+1)st ones of the Y electrodes 65, respectively.

As shown in FIG. 14(*b*), when a scan pulse 86 is applied to the ith row of the Y electrodes 65, in a cell located at an intersection of the ith row of the Y electrodes 65 with the A electrode 59 supplied with the voltage V0, first an address discharge occurs between the Y electrode and the A electrode, and then an address discharge occurs between the ith row of the Y electrodes 65 and the X electrode. No address discharges occur at cells located at intersections of the ith row of the Y electrodes 65 and with the A electrode 59 at ground potential.

The above applies to a case where a scan pulse 87 is applied to the (i+1)st one of the Y electrodes 65.

As shown in FIG. 12, in the cell where the address discharge has occurred, charges (wall discharges) are generated by the discharges on the surface of the dielectric substance 56 and the protective film 57 covering the X and Y electrodes, and consequently, a wall voltage Vw V occurs between the X and Y electrodes. As explained already, in FIG. 12, reference numeral 66 denote electrons, 67 is a positive ion, 68 is a positive wall charge, and 69 are negative wall charges. Occurrence of sustain discharge during the succeeding sustain period 81 depends upon the presence of this wall charge.

FIG. 14(*c*) illustrates sustain pulse voltages applied to the X and Y electrodes serving as the sustain electrodes all at the same time during the sustain period 81 shown in FIG. 14(*a*). The X electrode is supplied with a sustain pulse voltage of a voltage waveform 88, the Y electrode is supplied with a sustain pulse voltage of a voltage waveform 89, and the magnitude of the voltages of the waveforms 88 and 89 is V3 V The A electrode 59 is supplied with a driving voltage of a voltage waveform 90 which is kept at a fixed voltage V4 V during the sustain period. The voltage V4 may be selected to be ground potential. The sustain pulse voltages of the magnitude V3 is applied alternately to the X electrode and the Y electrode, and as a result the reversal of the polarity of the voltage between the X and Y electrodes is repeated. The magnitude V3 is selected such that the presence and absence of the wall voltage generated by the address discharge correspond to the presence and absence of the sustain discharge, respectively.

In a discharge cell where the address discharge has occurred, discharge is started by the first sustain voltage pulse, the discharge continues approximately until wall charges of the opposite polarity accumulate to cancel the applied voltage. Since the wall voltage accumulated due to this discharge has the same polarity as that of the second sustain voltage pulse of the polarity opposite from that of the first sustain voltage pulse, another discharge occurs again. The above is repeated after application of the third, fourth and succeeding sustain voltage pulses.

In this way, in the discharge cell where the address discharge has occurred, sustain discharges occur between the X and Y electrodes the number of times equal to the number of the applied voltage pulses and thereby they emit light. On the other hand, light is not generated in the discharge cells where the address discharge has not occurred.

The above is the basic configuration of the conventional plasma display device and its conventional driving method.

With the advent of competitive devices in the market for thin large-screen TV receivers, the improvement of luminous efficacy of the PDP is becoming increasingly important. As reported in "High Efficacy PDP," SID 03, pp. 28-31, increasing of the partial pressure of Xe in the discharge gas of the PDP is known as a means for improving the luminous efficacy of the PDP. However, since a driving voltage (a sustain voltage) is increased by increasing of the partial pressure of Xe in this method, there arises a problem in that the amount of ion bombardment induced sputtering from the protective film is increased, and consequently, the lifetime is decreased. In general, as measures against the increase in the amount of ion bombardment induced sputtering due to an increase in sustain voltages, reported are methods of improving the protective films such as a method by increasing the thickness of the protective film, and a method by using the protective film having a high secondary electron emission coefficient. By way of example, JP 2003-151446 A discloses a method of lowering driving voltages by using a two-layer protective film of CaO/MgO and lengthening a lifetime of the protective film by increasing its thickness, and JP 2004-71367 A discloses a method of lengthening a lifetime of the protective film by lowering driving voltages by fabricating the protective film from a material (diamond) other than MgO. However, it is thought that there are various problems with putting those protective films to practical use. Therefore there have been demands for a method of suppressing deterioration of protective films over operating time of the PDP, other than the method of improving the protective films.

SUMMARY OF THE INVENTION

The improvement of luminous efficacy is one of the most important problems to be solved with the PDP. It is an object of the present invention to provide a technology for suppressing deterioration of protective films over operating time due to an increase in driving voltages as well as improving luminous efficacy by increasing the partial pressure of the xenon gas, in plasma display devices such as plasma TV (PDP-TV) receivers or the like employing plasma display panels.

The following will explain briefly the summary of the representative ones of the present inventions disclosed in this specification.

(1) A plasma display device comprising: a plasma display panel provided with at least a plurality of discharge cells each having at least discharge gas, a pair of sustain electrodes which generate sustain discharge for light-emission display, and a phosphor which generates visible light by being excited by ultraviolet rays generated by said sustain discharge; and a driving circuit which applies a sustain pulse voltage between said pair of sustain electrodes for generating said sustain discharge, wherein said sustain pulse voltage is comprised of a first portion having a main portion of a first voltage Vp V and a second portion succeeding said first portion in time and having a main portion of a second voltage Vs V higher than said first voltage Vp V, said sustain discharge is comprised of a pre-discharge and a main discharge succeeding said pre-discharge in time, and said first voltage Vp V is selected to satisfy the following inequality: $Vpmin \leqq Vp < Vs$, where Vpmin V is a minimum of said first voltage Vp V which stabilizes said sustain discharge.

(2) A plasma display device comprising: a plasma display panel provided with at least a plurality of discharge cells each having at least discharge gas, a pair of sustain electrodes which generate sustain discharge for light-emission display, and a phosphor which generates visible light by being excited by ultraviolet rays generated by said sustain discharge; and a driving circuit which applies a sustain pulse voltage between said pair of sustain electrodes for generating said sustain discharge, wherein said sustain pulse voltage is comprised of a first portion having a main portion of a first voltage Vp V and a second portion succeeding said first portion in time and having a main portion of a second voltage Vs V higher than said first voltage Vp V, said sustain discharge is comprised of a pre-discharge and a main discharge succeeding said pre-discharge in time, said first voltage Vp V is selected to satisfy the following inequality: $Vpmin \leqq Vp < Vs$, where Vpmin V is a minimum of said first voltage Vp V which stabilizes said sustain discharge, and said discharge gas contains xenon of a concentration in a range of from 6.5% to 50%.

(3) A plasma display device comprising: a plasma display panel provided with at least a plurality of discharge cells each having at least discharge gas, a pair of sustain electrodes which generate sustain discharge for light-emission display, and a phosphor which generates visible light by being excited by ultraviolet rays generated by said sustain discharge; and a driving circuit which applies a sustain pulse voltage between said pair of sustain electrodes for generating said sustain discharge, wherein said sustain pulse voltage is comprised of a first portion having a main portion of a first voltage Vp V and a second portion succeeding said first portion in time and having a main portion of a second voltage Vs V higher than said first voltage Vp V, said sustain discharge is comprised of a pre-discharge and a main discharge succeeding said pre-discharge in time, and said first voltage Vp V is selected to satisfy the following inequality: $Vpmin \leqq Vp < Vs-10$, where Vpmin is a minimum of said first voltage Vp V which stabilizes said sustain discharge, and said discharge gas contains xenon of a concentration in a range of from 6.5% to 50%.

(4) The plasma display device according to (1), wherein said sustain pulse voltage includes a portion having a pulse repetition period in a range of from 4 μs to 13 μs.

(5) The plasma display device according to (2), wherein said sustain pulse voltage includes a portion having a pulse repetition period in a range of from 4 μs to 13 μs.

(6) The plasma display device according to (3), wherein said sustain pulse voltage includes a portion having a pulse repetition period in a range of from 4 μs to 13 μs.

(7) The plasma display device according to (1), wherein said sustain pulse voltage includes a portion having a pulse repetition period in a range of from 6 μs to 13 μs.

(8) The plasma display device according to (2), wherein said sustain pulse voltage includes a portion having a pulse repetition period in a range of from 6 μs to 13 μs.

(9) The plasma display device according to (3), wherein said sustain pulse voltage includes a portion having a pulse repetition period in a range of from 6 μs to 13 μs.

(10) The plasma display device according to (1), wherein a load factor is defined as a ratio of a number of lighted cells among said plurality of discharge cells at a given point of time to a total number of said plurality of discharge cells, a pre-discharge ratio is defined as a ratio of an integral of a waveform of a discharge current integrated over a time of said pre-discharge to an integral of a waveform of a discharge current generated by one sustain pulse voltage in said sustain discharge, and when said load factor of a display is smaller, said first voltage Vp V and said second voltage Vs V are selected to make said pre-discharge ratio greater than that when said load factor of a display is larger.

(11) The plasma display device according to (1), wherein a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: $Vpmin=2\ Vsmin-Vs-50$.

(12) The plasma display device according to (3), wherein a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: $Vpmin=2\ Vsmin-Vs-50$.

(13) The plasma display device according to (1), wherein said plurality of sustain electrodes forming said plurality of discharge cells extend in a first direction, and are arranged at equal intervals in a second direction intersecting said first direction, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: $Vpmin=2\ Vsmin-Vs-10$.

(14) The plasma display device according to (3), wherein said plurality of sustain electrodes forming said plurality of discharge cells extend in a first direction, and are arranged at equal intervals in a second direction intersecting said first direction, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: $Vpmin=2\ Vsmin-Vs-10$.

(15) The plasma display device according to (1), wherein said plurality of sustain electrodes forming said plurality of discharge cells extend in a first direction, and are arranged at equal intervals in a second direction intersecting said first direction, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: $Vpmin=2\ Vsmin-Vs-35$.

(16) The plasma display device according to (3), wherein said plurality of sustain electrodes forming said plurality of discharge cells extend in a first direction, and are arranged at equal intervals in a second direction intersecting said first direction, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: Vpmin=2 Vsmin−Vs−35.

(17) The plasma display device according to (1), wherein said plurality of sustain electrodes forming said plurality of discharge cells extend in a first direction, and are arranged in a second direction intersecting said first direction such that a spacing between two adjacent pairs of sustain electrodes is larger than a spacing between two sustain electrodes forming one of said two adjacent pairs, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: Vpmin=2 Vsmin−Vs−25.

(18) The plasma display device according to (3), wherein said plurality of sustain electrodes forming said plurality of discharge cells extend in a first direction, and are arranged in a second direction intersecting said first direction such that a spacing between two adjacent pairs of sustain electrodes is larger than a spacing between two sustain electrodes forming one of said two adjacent pairs, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: Vpmin=2 Vsmin−Vs−25.

(19) The plasma display device according to (1), wherein said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: Vpmin=2 Vsmin−Vs−45.

(20) The plasma display device according to (1), wherein said pair of sustain electrodes are arranged to face each other in a direction perpendicular to major surfaces of said sustain electrodes, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation: Vpmin=2 Vsmin−Vs−50.

The present invention provides a plasma display device employing a driving method which realizes stable pre-discharges in displays of various load factors, in particular, in displays of small load factors, and thereby provides an advantage of increasing the lifetime of the protective film of the PDP. The present invention provides advantages of decreasing or suppressing deterioration of protective films over operating time due to an increase in sustain voltages, especially in a case where a proportion of Xe gas in a discharge gas is selected to be high.

BRIEF DESCRIPTION OF THE DRAWINGS

In the accompanying drawings, in which like reference numerals designate similar components throughout the figures, and in which:

FIG. 3(*b*) is a plan view of the straight ribs only, used in the ac three-electrode surface-discharge type PDP of Embodiment 1, viewed from the direction corresponding to the direction D3 depicted in FIG. 10;

FIG. 4(*b*) is a plan view of the box rib only, used in the ac three-electrode surface-discharge type PDP of the example of Embodiment 1, viewed from the direction corresponding to the direction D3 depicted in FIG. 10;

FIG. 6(*b*) is a plan view of the straight ribs only, used in the ac three-electrode surface-discharge type PDP of Embodiment 2, viewed from the direction corresponding to the direction D3 depicted in FIG. 10;

FIG. 14(*b*) illustrates waveforms of voltages applied to an A electrode 59, an X electrode 64 and a Y electrode 65 during the address period 80 shown in FIG. 14(*a*);

FIG. 14(*c*) illustrates sustain pulse voltages applied to the X and Y electrodes, which are the sustain electrodes, all at the same time, and a voltage applied to the address electrodes, during the sustain period 81 shown in FIG. 14(*a*);

FIG. 15(*b*) is a plan view of the box rib only, used in the ac three-electrode surface-discharge type PDP of Embodiment 2, viewed from the direction corresponding to the direction D3 depicted in FIG. 10;

DETAILED DESCRIPTION OF THE PREFERRED EMBODIMENTS

Figure 1:
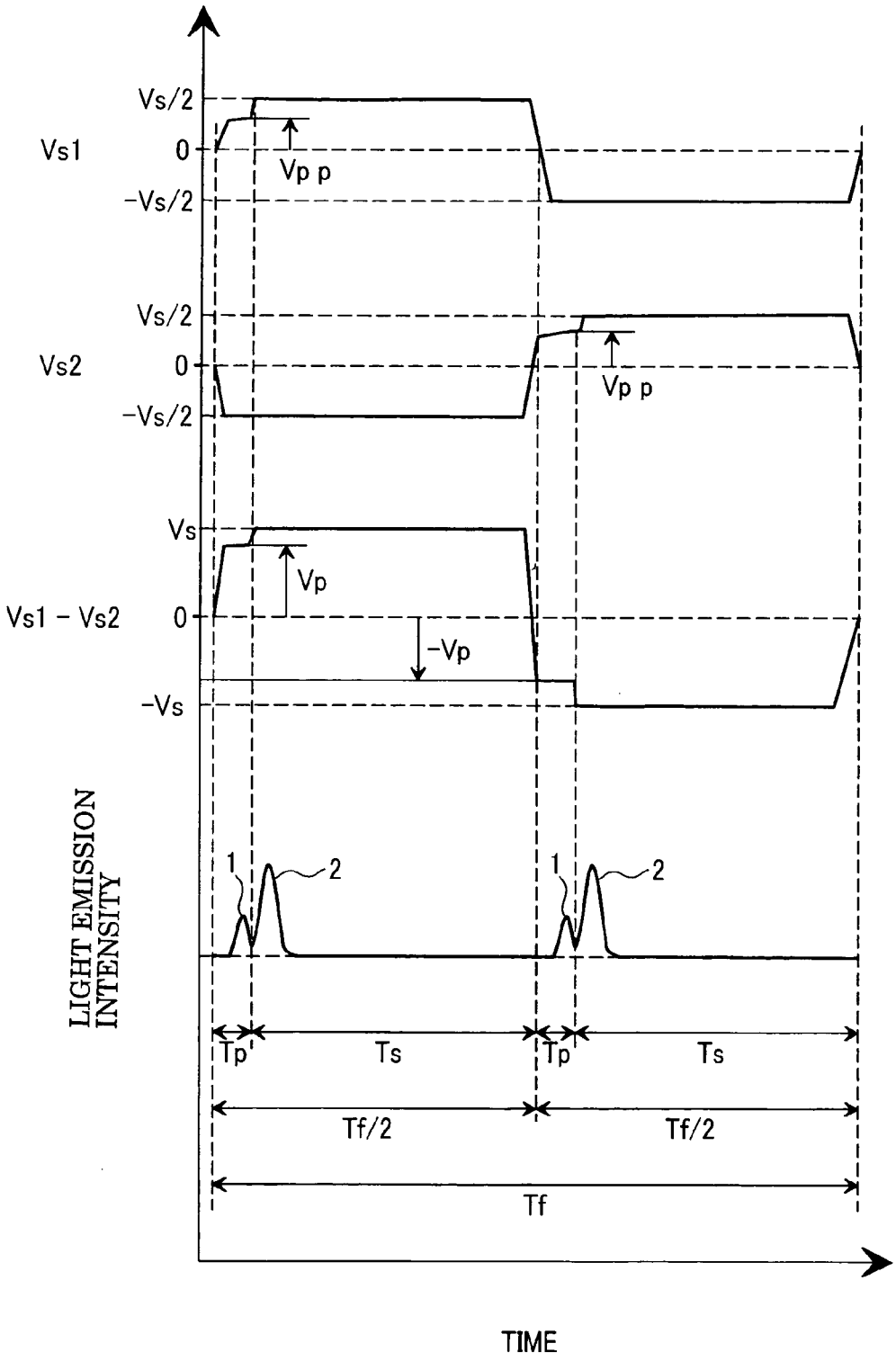
FIG. 1 illustrates sustain pulse waveforms (Vs1, Vs2) applied to sustain electrodes (X1 electrodes, X2 electrodes, Y1 electrodes and Y2 electrodes) during a sustain period of a plasma display device in accordance with Embodiment 1 of the present invention, a waveform of a difference (Vs1−Vs2), and a waveform of light emission intensity.

In a case where a partial pressure of Xe in a discharge gas sealed in a PDP is increased for the purpose of improving luminous efficacy of the PDP, a required sustain voltage for the PDP is increased, and consequently, the lifetime of a protective film in the PDP is decreased due to an increase in the amount of ion sputtering from the protective film. To avoid the decrease in lifetime, the ion sputtering of the protective film needs to be suppressed. Since a wall voltage approximately equal in magnitude to an increase in a sustain voltage is generated between the sustain electrodes of a discharge cell, a discharge-space voltage is increased to about two times the driving voltage. Here the discharge-space voltage is defined as a voltage effectively applied between two sustain electrodes in a discharge cell, and is a sum of a sustain voltage applied from a driving circuit and a wall voltage generated by a wall discharge accumulated on a front dielectric formed on the surfaces of the electrodes. Since this discharge-space voltage is increased by about two times the increase in the sustain voltage, the amount of ion sputtering from the protective film is increased considerably, and thereby the lifetime of the protective film is shortened.

To suppress the above-mentioned increase in the discharge-space voltage, it is usually necessary to lower the sustain voltage. A usual measure has been used which lowers the sustain voltage itself by improving the secondary-electron-emission coefficient of the protective film made of MgO, and thereby lowering a firing voltage.

There is an alternative method for suppressing the increase in the discharge-space voltage. The alternative method can suppress the increase in the discharge-space voltage even when the sustain (driving) voltage itself is increased by increasing the partial pressure of Xe in a discharge gas. By experiments it was found out that the amount of sputtering from the protective films was largest in the vicinities of the X and Y electrodes adjacent to discharge gaps there between because electric fields concentrate at edges of the electrodes. That is to say, the lifetime of the protective films is determined by ion sputtering in an early stage of the sustain discharge. Therefore the decreasing of lifetime of the protective film can be suppressed by making the discharge-space voltage immediately before the start of the sustain discharge as low as possible. For that purpose, a sustain voltage Vp at the start of a sustain discharge is selected to be lower than a usual sustain voltage Vs. Initially a discharge is started at a driving voltage Vp, and then the driving voltage is raised to a voltage Vs before ceasing of the initial discharge, to continue the discharge and accumulate a wall charge. The above causes the wall voltage to be approximately equal to Vs, and when a succeeding sustain pulse, a driving voltage Vp, is applied, the discharge-space voltage is made approximately equal to (Vs+Vp). Therefore the discharge-space voltage at the start of the sustain discharge is lower than the usual voltage 2 Vs, ion sputter from the protective film is suppressed, and consequently, the decreasing of lifetime of the protective film can be suppressed. A driving method is called a two-step discharge driving method which employs a sustain driving waveform comprising an initial sustain voltage Vp and a succeeding voltage Vs.

The two-step discharge driving method performs a sustain discharge comprising at least two steps comprising a pre-discharge generated during a period of the driving voltage Vp and a main discharge generated during a period of the driving voltage Vs. Here, a pulse-applied period is defined as a period in which sustain electrodes are supplied with a voltage equal to or higher than the driving voltage Vs, and a pre-discharge period is defined as a period in which the sustain electrodes are supplied with the driving voltage Vp. Therefore, since the pre-discharge is generated by a low discharge-space voltage, it exhibits high luminous efficacy. Further, in the main discharge succeeding the pre-discharge, the wall voltage has been lowered by the pre-discharge, resulting in a lower discharge-space voltage compared with that in the conventional driving method, and consequently, high luminous efficacy is obtained. The reason that the main discharge is generated even at the low discharge-space voltage is due to priming effects provided by space charges generated by the pre-discharge. Therefore, the two-step discharge driving can realize a desired low discharge-space voltage by using a driving voltage equal to a conventional driving voltage. As a result, even if a required driving voltage is increased by increasing the partial pressure of Xe in a discharge gas sealed in a PDP, the increase in the discharge-space voltage at the start of a discharge can be suppressed. Consequently, since the discharge-space voltage is not raised even if the sustain driving voltage is increased by increasing the partial pressure of Xe, the decreasing of lifetime of the protective films can be suppressed.

However, as described JP 2005-10398, the two-step discharge driving method required the lengthening of the sustain pulse repetition period for the purpose of obtaining a stable discharge.

In PDPs, a load factor is defined as a ratio of the number of lighted discharge cells at a given point of time to the number of all the discharge cells included in the panel. However, in some cases, the load factor is defined as a ratio of the number of lighted discharge cells at a given point of time among discharge cells arranged in a given line in a direction of an extension of sustain electrode pairs, to the number of all the discharge cells arranged in the line.

In the case of PDPs, an APC (Automatic Power Control) is used for the purpose of keeping power consumption below a certain value for a display of a large load factor. The APC increases the number of sustain pulses as the load factor decreases, for the purpose of keeping power consumption below a certain value. As a result, in displays of smaller load factors, the frequency of ion sputtering from the protective films is increased, and the protective films are more susceptible to the decreasing of lifetime, the image sticking and others. Therefore, for the purpose of reducing and suppressing of the decreasing of lifetime of the protective films, the image sticking and others, especially in the case of displays of small load factors, it is important to lower the discharge-space voltage at the start of a discharge.

However, in the case of displays of small load factors, since the number of sustain pulses needs to be increased, the two-step discharge driving method cannot be employed which has the sustain pulse repetition period lengthened for the purpose of stable driving. Therefore, in a case where the two-step discharge driving method is employed in displays of small load factors, it is necessary to achieve stable driving without lengthening the sustain pulse repetition period. It was found out that stable driving without increasing the sustain pulse repetition period can be realized by selecting the pre-discharge voltage Vp to be equal to or higher than a specific voltage Vpmin. That is to say, in a case where a sustain pulse repetition period is equal to or shorter than 13 μs, the minimum value Vpmin of the pre-discharge voltage Vp capable of a stable two-step discharge driving is specified by the following conditions:

$$Vp\min \leqq Vp < Vs,\ Vp\min = 2\ Vs\min - Vs - \alpha,$$

where α is determined based upon a structure of discharge cells and a method of driving the discharge cells.

Here, the sustain pulse repetition period is a repetition period with which a pair of sustain pulses applied to X and Y electrodes, respectively, is repeated. Vsmin is the minimum voltage (the minimum sustain-maintaining voltage) of the lowest voltages capable of stably maintaining respective ones of various sustain discharges for various displays. In other words, there is the lowest voltage capable of stably maintaining a sustain discharge in each of various displays, that is to say, there is the minimum sustain-maintaining voltage for each of the various displays. The minimum sustain-maintaining voltage, Vsmin, is the minimum of the lowest sustain-maintaining voltages for respective ones of various displays. The lowest sustain-maintaining voltages for respective ones of various displays are the lowest sustain voltages capable of producing flicker-free normal displays in the respective image displays when the sustain voltages Vs are lowered in the image displays. In many cases, the minimum sustain-maintaining voltage Vsmin is the lowest sustain-maintaining voltage for the case of displaying white over the entire display area, that is, in the case-of the maximum load-factor displaying.

The conditions specified by the above formulas are effective especially for cases where the sustain pulse repetition period is equal to or shorter than 13 μs, and it is needless to say that the conditions specified by the above formulas are also effective for cases where the sustain pulse repetition period is longer than 13 μs. The inequality Vp<Vs is specified because in a case where Vp=Vs, the driving waveform is the same as that of the conventional driving method, and therefore the decreasing of lifetime of the protective films, image sticking and others cannot be reduced or suppressed. Further, it is preferable that the inequality Vp<Vs−10 is satisfied to further reduce or suppress the decreasing of lifetime of the protective films and image sticking.

α included in the above equation for determining Vpmin is selected as follows based on a structure of discharge cells and a method of driving the discharge cells.

(1) In the case of a double-slit driving by using the above-mentioned regular and reverse slits and a straight-rib structure (later explained in connection with FIG. 3), since instability of discharges occurs easily, α=10 V.

(2) In the case of the double-slit driving by using the above-mentioned regular and reverse slits and a box-rib structure (later explained in connection with FIG. 4), since occurrence of instability of discharges is suppressed, α=35 V.

(3) In the case of a regular-slit driving by using the above-mentioned regular slits and a straight-rib structure (later explained in connection with FIG. 6), since the width of the reverse slits is selected to be wider than that of the regular slits, instability of discharges occurs less easily than in the case of (1), α=25 V.

(4) In the case of a regular-slit driving by using the above-mentioned regular slits and a box-rib structure (later explained in connection with FIG. 6), since discharges are further stabilized, α=40 V.

(5) In the case of a two-electrode vertical-discharge cell structure in which discharges are generated between two electrodes facing each other across a gap between opposing substrates of a PDP (later explained in connection with FIG. 9), since the degree of separation between adjacent discharge cells is high due to the box-rib structure, α=50 V.

(6) In a case where a pre-discharge for a display of a smaller load factor is made greater than that for a display of a larger load factor. Since the pre-discharge is generated by a low applied voltage, the discharge-space voltage is low. When a proportion of the pre-discharge is increased, lowered is the discharge-space voltage in the earlier half of the sustain discharge which influences the lifetime, and the decreasing of lifetime of the protective films and image sticking induced by the protective films are reduced.

(7) Especially in a PDP in which the partial pressure of Xe is increased (the partial pressure of Xe≧6.5%), and in which a driving voltage is increased as the result of the increased partial pressure of Xe, when the driving of (6) is employed, even if the driving voltage is increased, an increase in the discharge-space voltage can be suppressed and consequently, the decreasing of lifetime of the protective films can be prevented.

The above (1) to (6) are effective for improving the lifetime of the protective films of PDPs regardless of whether the partial pressure of Xe is increased or not.

Now the embodiments of the present invention will be explained in detail by reference to the drawings. All the drawings for the embodiments use the same reference numerals to identify parts performing the same functions, which are not repeatedly explained in the specification.

Embodiment 1

Figure 2:
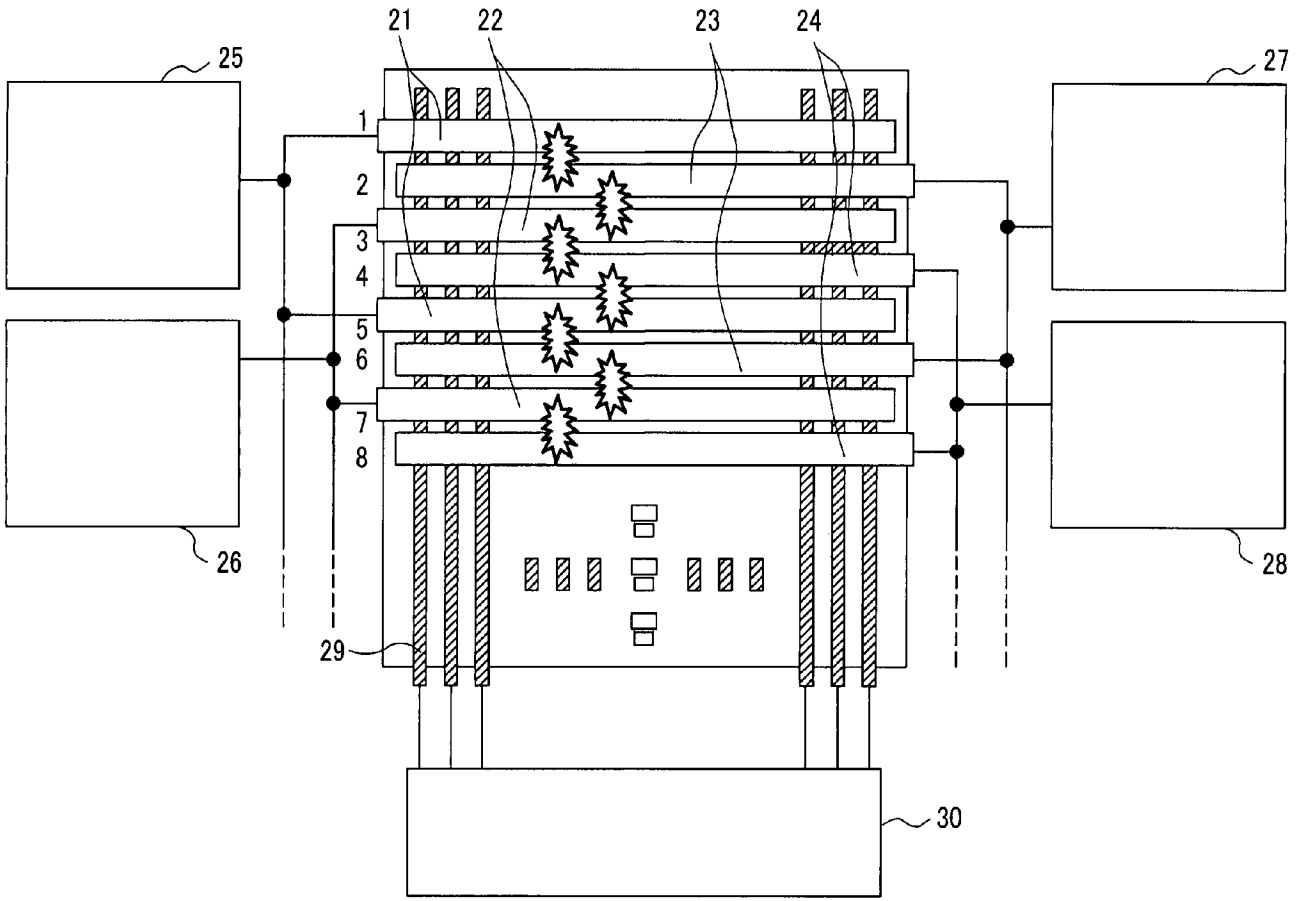
FIG. 2 illustrates an arrangement of electrodes within an ac three-electrode surface-discharge type PDP in accordance with Embodiment 1 of the present invention, a basic configuration of a driving circuit thereof, and light emissions generated by discharges.
Figure 3A:
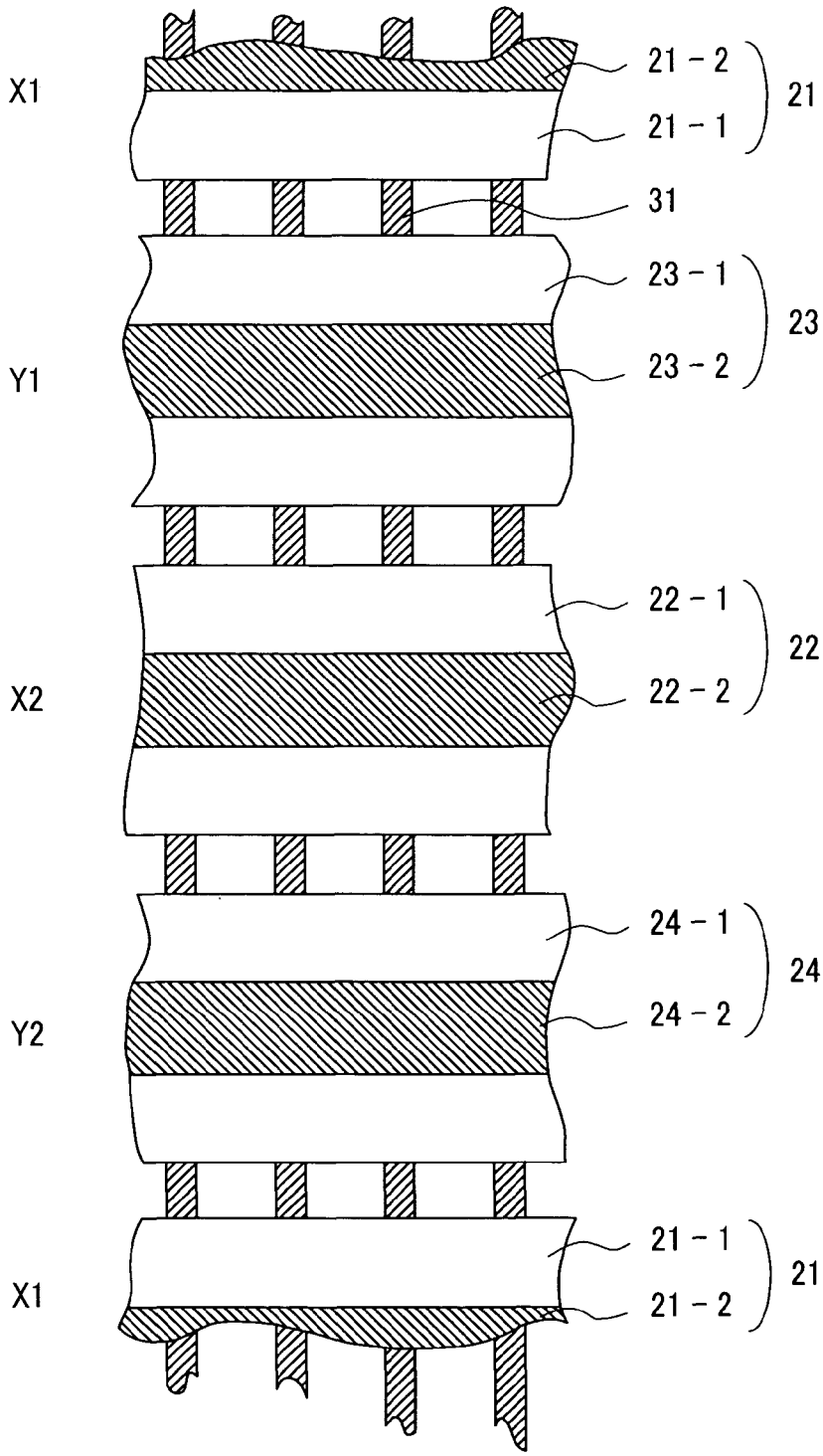
FIG. 3(*a*) is a plan view of straight ribs and electrodes used in the ac three-electrode surface-discharge type PDP of Embodiment 1, viewed from a direction corresponding to a direction D3 depicted in FIG. 10.
Figure 3B:
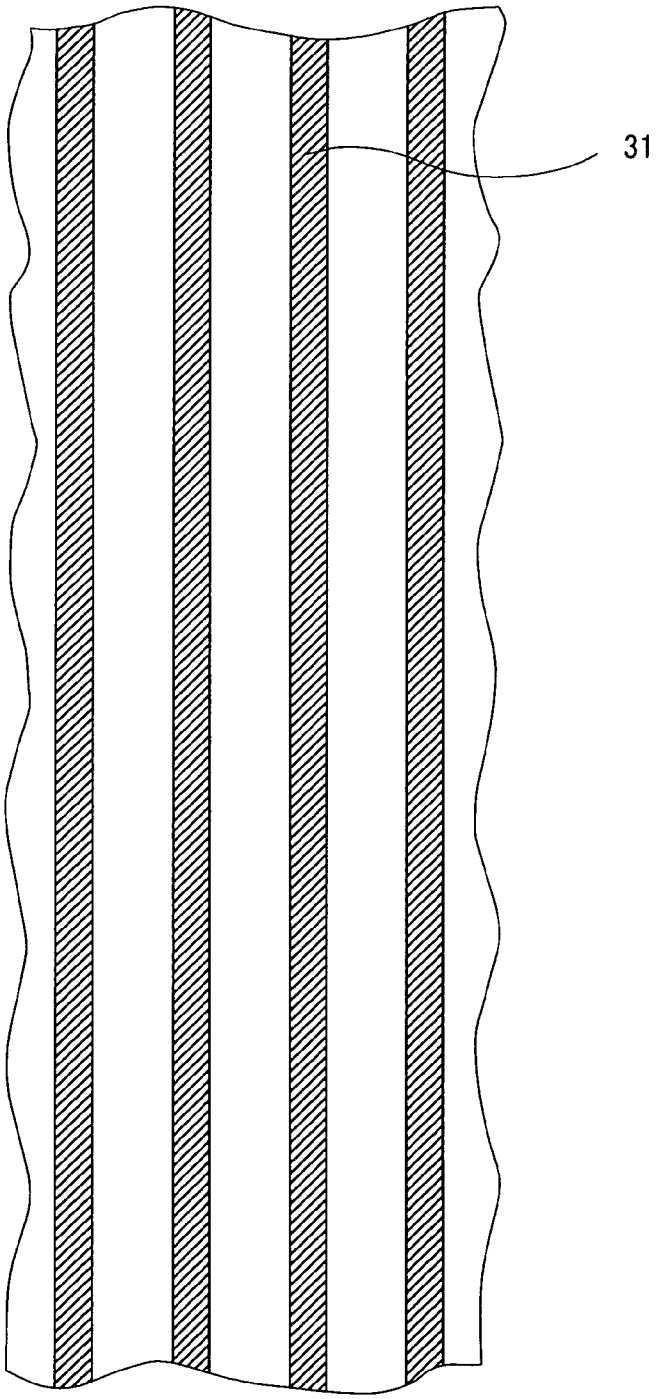
Figure 10:
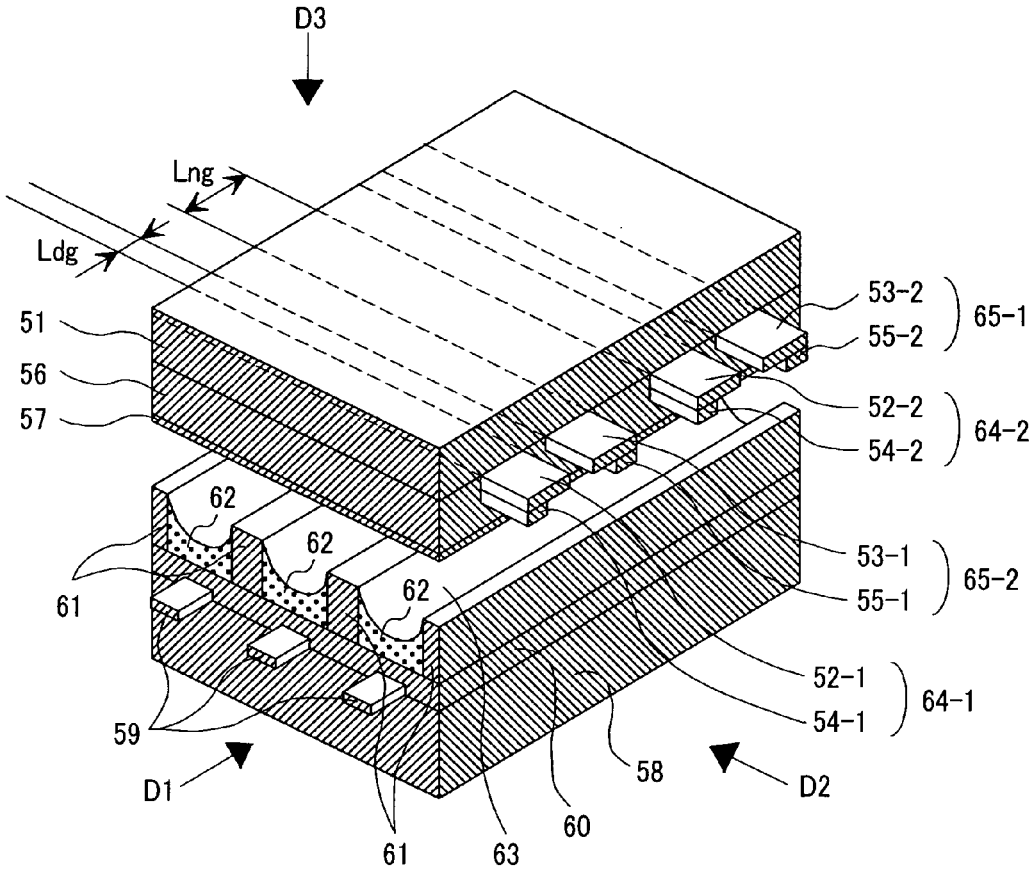
FIG. 10 is an exploded perspective view of an example of a conventional ac three-electrode surface-discharge type PDP.
Figure 11:
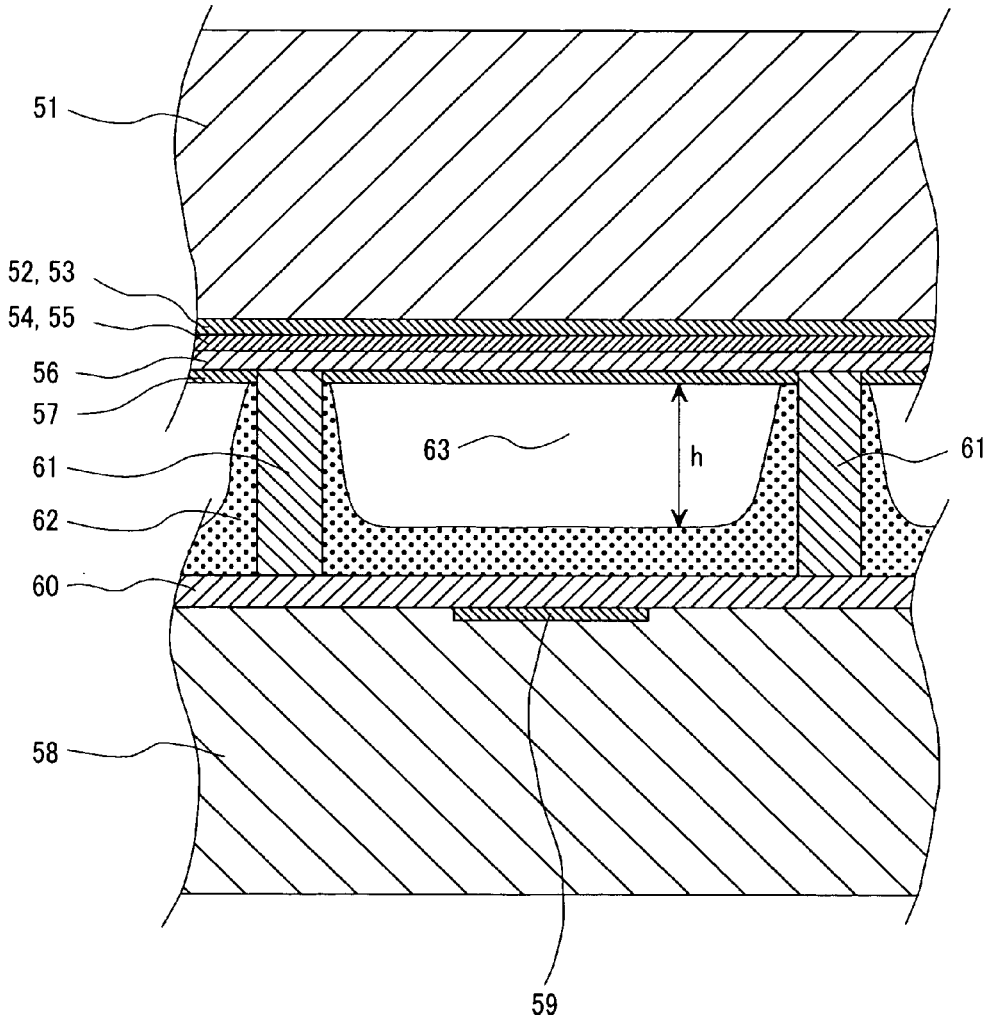
FIG. 11 is a cross-sectional view of a plasma display panel shown in FIG. 10 viewed in a direction of an arrow D1.
Figure 12:
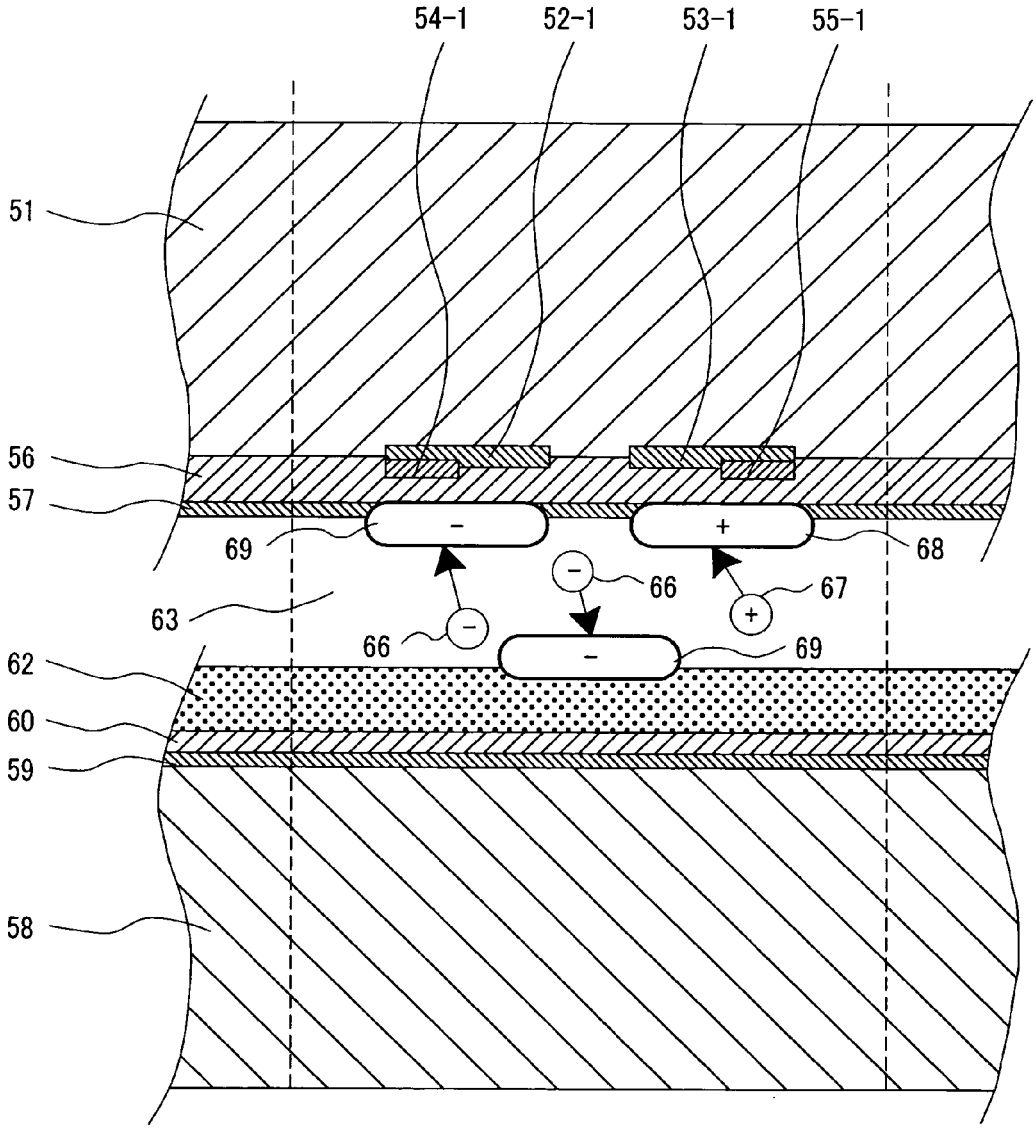
FIG. 12 is a cross-sectional view of the plasma display panel shown in FIG. 10 viewed in a direction of an arrow D2.
Figure 13:
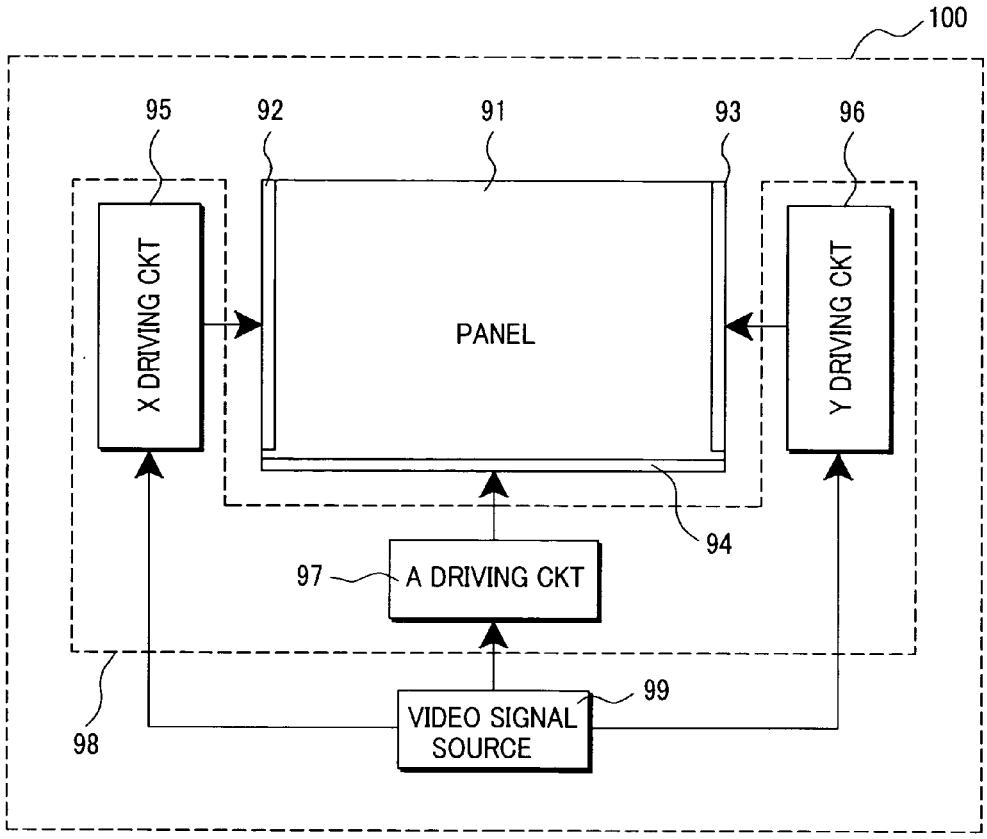
FIG. 13 is a block diagram illustrating a basic configuration of a conventional plasma display device.

FIG. 2 illustrates an arrangement of electrodes within an ac three-electrode surface-discharge type PDP in accordance with Embodiment 1 of the present invention, a basic configuration of a driving circuit thereof, and light emissions generated by discharges. FIGS. 3(*a*) and 3(*b*) are illustrations for explaining an example using straight ribs 31 as rib members for separating discharge cells from each other in the ac three-electrode surface-discharge type PDP of Embodiment 1. FIG. 3(*a*) is a plan view of the straight ribs 31 and electrodes 21-24 of the ac three-electrode surface-discharge type PDP of Embodiment 1, viewed from a direction corresponding to the direction D3 depicted in FIG. 10, and FIG. 3(*b*) is a plan view of the straight ribs 31 only, viewed from a direction corresponding to the direction D3 depicted in FIG. 10.

The ac three-electrode surface-discharge type PDP of Embodiment 1 of the present invention comprises X1 electrodes 21, X2 electrodes 22, Y1 electrodes 23, Y2 electrodes 24, an X1 sustain driving circuit (PX1) 25, an X2 sustain driving circuit (PX2) 26, a Y1 sustain driving circuit (PY1) 27, a Y2 sustain driving circuit (PY2) 28, A electrodes (address electrodes) 29, and an address circuit 30.

The X electrodes comprise two kinds of electrodes, the X1 electrodes 21 and the X2 electrodes 22, and the Y electrodes comprise two kinds of electrodes, the Y1 electrodes 23 and the Y2 electrodes 24. Each of the X1 electrodes 21 comprises an X1 transparent electrode 21-1 and an X1 bus electrode 21-2, each of the X2 electrodes 22 comprises an X2 transparent electrode 22-1 and an X2 bus electrode 22-2, each of the Y1 electrodes 23 comprises a Y1 transparent electrode 23-1 and a Y1 bus electrode 23-2, and each of the Y2 electrodes 24 comprises a Y2 transparent electrode 24-1 and a Y2 bus electrode 24-2. The X1, X2, Y1, and Y2 electrodes are supplied with sustain voltages from the X1 sustain driving circuit (PX1) 25, the X2 sustain driving circuit (PX2) 26, the Y1 sustain driving circuit (PY1) 27, the Y2 sustain driving circuit (PY2) 28, respectively.

One field of 1/60 seconds forming one picture is divided into 10 subfields (generally n subfields) for producing gray scale representation. One subfield comprises a reset period, an address period and a sustain period as in the case of a conventional driving. The PDP of Embodiment 1 is driven by using interlaced scanning. That is to say, each of slits between the X and Y electrodes serves as regular and reverse slits alternately on successive fields formed by the interlaced scanning. To be concrete, in a given picture (field), an operation of reset, address and sustain discharge is performed for each of the subfields formed by discharge cells in odd-numbered rows (the first, third, fifth, seventh, . . . , rows in a vertical direction), and then in a next picture (field) immediately succeeding the given picture, an operation of reset, address and sustain discharge is performed for each of the subfields formed by discharge cells in even-numbered rows (the second, fourth, sixth, . . . , rows). In the discharges in the discharge cells in the odd-numbered rows, slits between the X1 and Y1 electrodes and slits between the X2 and Y2 electrodes serve as regular slits, and slits between the Y1 and X2 electrodes and slits between the Y2 and X1 electrodes serve as reverse slits. In the discharges in the discharge cells in the even-numbered rows, slits between the Y1 and X2 electrodes and slits between the Y2 and X1 electrodes serve as regular slits, and slits between the X1 and Y1 electrodes and slits between the X2 and Y2 electrodes serve as reverse slits.

Figure 14A:
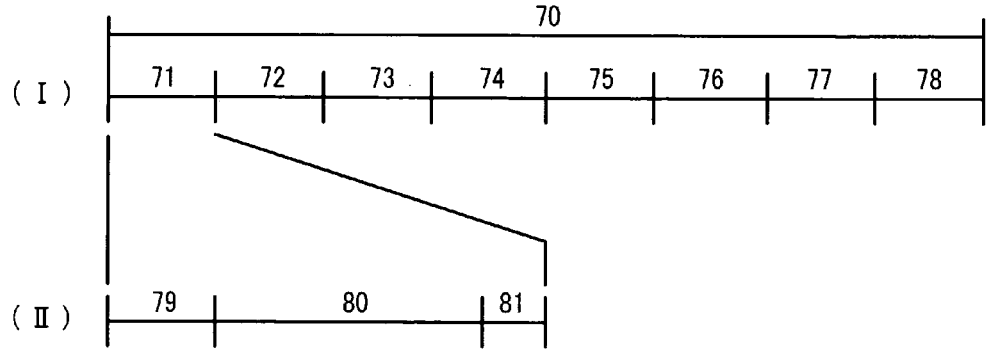
FIG. 14(*a*) is a time chart illustrating a driving voltage during one TV field required for displaying one picture on the PDP shown in FIG. 10.
Figure 14B:
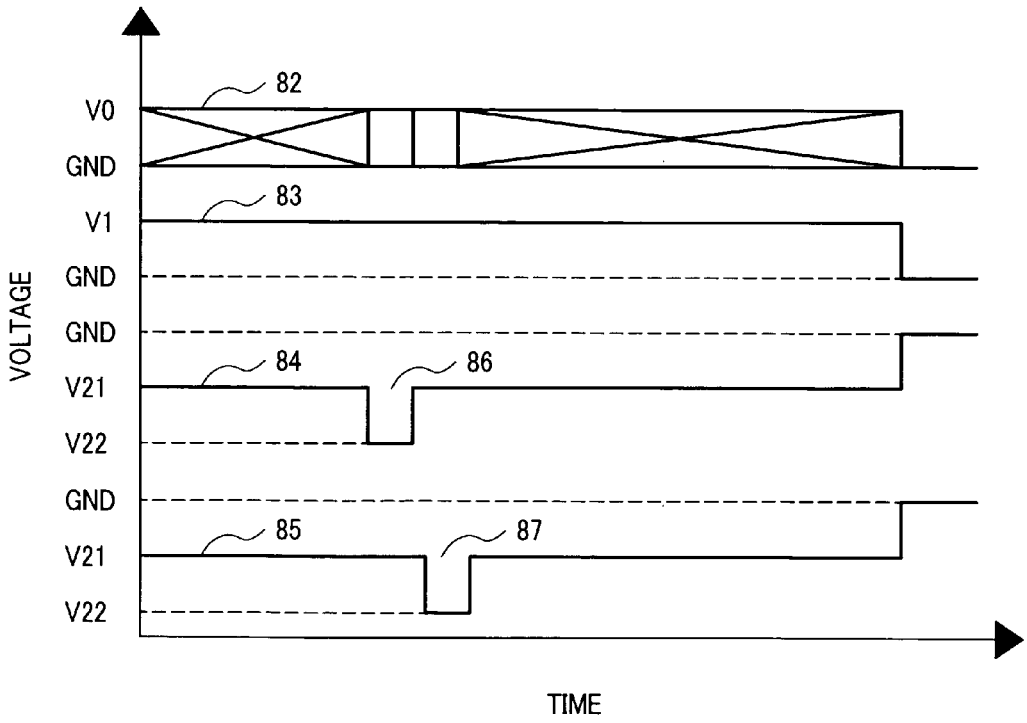
Figure 14C:
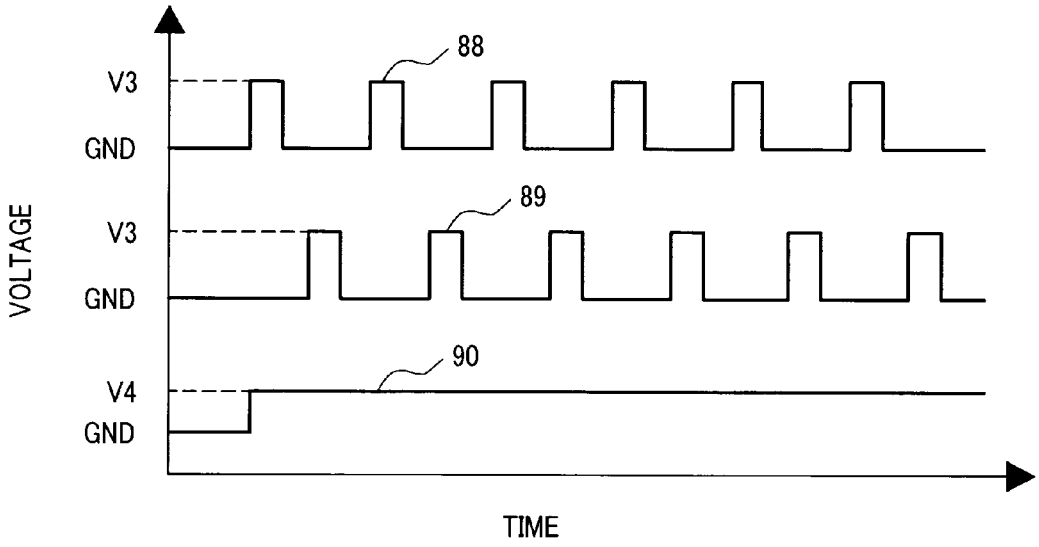

As shown in FIG. 14(*b*), during the address period of each of the subfields, the A electrodes 29 supplied with a voltage from the address driving circuit 30 receive a pulse voltage denoted by reference numeral 82, the X1 or X2 electrodes are supplied with a voltage denoted by reference numeral 83, the Y1 or Y2 electrodes are supplied with pulse voltages denoted by reference numerals 84-87, and as a result, wall charges are accumulated in discharge cells desired to be lighted during the sustain period.

FIG. 1 illustrates sustain pulse waveforms (Vs1, Vs2) applied to the sustain electrodes (the X1 electrodes, X2 electrodes, Y1 electrodes and Y2 electrodes) during the sustain period 81 (see FIG. 14(*a*)) of the plasma display device in accordance with Embodiment 1 of the present invention, a waveform of the difference (Vs1−Vs2), and a waveform of light emission during one sustain period Tf. For generation of the sustain discharges in the discharge cells in the odd-numbered rows, the sustain pulse Vs1 is applied to the X1 and Y2 electrodes, and the sustain pulse Vs2 is applied to the X2 and Y1 electrodes. Therefore, a potential difference is not generated across the reverse slits, a potential difference is generated only across the regular slits, and consequently, the sustain discharges are generated only between the electrodes sandwiching the regular slits (between the X1 and Y1 electrodes, and between the X2 and Y2 electrodes). For generation of the sustain discharges in the discharge cells in the even-numbered rows, the sustain pulse Vs1 is applied to the X1 and Y1 electrodes, and the sustain pulse Vs2 is applied to the X2 and Y2 electrodes. Therefore, a potential difference is not generated across the reverse slits, a potential difference is generated only across the regular slits, and consequently, the sustain discharges are generated only between the electrodes sandwiching the regular slits (between the Y1 and X2 electrodes, and between the Y2 and X1 electrodes). Two sustain electrodes for generating discharges therebetween are supplied with Vs1 or Vs2, and the difference (Vs1−Vs2) are applied between the two sustain electrodes. The address voltage is always kept at ground potential during the sustain period (not shown).

As shown in FIG. 1, one repetition period Tf of the sustain period comprises at least a pre-discharge period Tp and a sustain-pulse-applied period Ts. In the former half, Tf/2, of the repetition period, Vpp is applied to the sustain electrodes during the pre-discharge period Tp of Vs1, and Vs/2 is applied to the sustain electrodes during the sustain-pulse-applied period Ts. Vs2 during the former half, Tf/2, of the repetition period is selected to be −Vs/2. Therefore the difference (Vs1−Vs2) is Vp=Vs/2+Vpp during the pre-discharge period Tp, and is Vs during the sustain-pulse-applied period Ts.

During the latter half, Tf/2, of the repetition period, the relationship between Vs1 and Vs2 is reversed, the difference (Vs1−Vs2) is −Vp=−Vs/2−Vpp during the pre-discharge period Tp, and is −Vs during the sustain-pulse-applied period Ts. With the above voltages applied, a pre-discharge 1 is generated between the sustain electrodes during the pre-discharge period Tp, and thereafter a main discharge 2 is generated in the sustain-pulse-applied period Ts. It was confirmed that luminous efficacy is improved by producing the sustain discharges following the pre-discharges compared with that obtained by conventional discharges without the pre-discharges.

As reported in the above-cited "High Efficacy PDP," SID 03, pp. 28-31, it is known that luminous efficacy is improved by increasing the partial pressure of Xe in a discharge gas sealed in PDPs compared with the conventional partial pressure of Xe. However, there is a problem in that a driving voltage (a sustain voltage) is increased, the amount of ion sputtering from the protective films is increased, and the lifetime of the protective films is decreased. To avoid this problem, the ion sputtering from the protective films needs to be suppressed. Since a wall voltage approximately equal in magnitude to an increase in a sustain voltage is generated between the sustain electrodes of a discharge cell, a discharge-space voltage is increased to about two times the driving voltage. Here the discharge-space voltage is defined as a voltage effectively applied between two sustain electrodes in a discharge cell, and is a sum of a sustain voltage applied from a driving circuit and a wall voltage generated by a wall discharge accumulated on a front dielectric formed on the surfaces of the electrodes. Since this discharge-space voltage is increased by about two times the increase in the sustain voltage, the amount of ion sputtering from the protective film is increased considerably, and thereby the lifetime of the protective film is shortened.

By our experiments it was found out that the amount of sputtering from the protective films was largest in the vicinities of the X and Y electrodes adjacent to discharge gaps therebetween. That is to say, the lifetime of the protective films is determined by ion sputtering in an early stage of the sustain discharge. Therefore the decreasing of lifetime of the protective film can be suppressed by making the discharge-space voltage immediately before the start of the sustain discharge as low as possible. For that purpose, a sustain voltage Vp at the start of a sustain discharge is selected to be lower than a usual sustain voltage Vs. Initially a discharge is started at a driving voltage Vp, and then the driving voltage is raised to a voltage Vs before ceasing of the initial discharge, to continue the discharge and accumulate a wall charge. The above causes the wall voltage to be approximately equal to Vs, and when a succeeding sustain pulse, a driving voltage Vp, is applied, the discharge-space voltage is made approximately equal to (Vs+Vp). Therefore the discharge-space voltage at the start of the sustain discharge is lower than the usual voltage 2 Vs, ion sputter from the protective film is suppressed, and consequently, the decreasing of lifetime of the protective film can be suppressed. A driving method is called a two-step discharge driving method which employs a sustain driving waveform comprising an initial sustain voltage Vp and a succeeding voltage Vs.

The two-step discharge driving method performs a sustain discharge comprising at least two steps comprising a pre-discharge generated during a period of the driving voltage Vp and a main discharge generated during a period of the driving voltage Vs. Here, a pulse-applied period is defined as a period in which sustain electrodes are supplied with a voltage equal to or higher than the driving voltage Vs, and a pre-discharge period is defined as a period in which the sustain electrodes are supplied with the driving voltage Vp. Therefore, since the applied voltage Vp is lower than Vs, the pre-discharge is generated by a low discharge-space voltage. Further, in the main discharge succeeding the pre-discharge, the wall voltage has been lowered by the pre-discharge, and therefore the discharge-space voltage is lower compared with that in the conventional driving method. The reason that the main discharge is generated even at the low discharge-space voltage is due to priming effects provided by space charges generated by the pre-discharge. Therefore, the two-step discharge driving can realize a desired low discharge-space voltage by using a driving voltage equal to a conventional driving voltage. As a result, even if a required driving voltage is increased by increasing the partial pressure of Xe in a discharge gas sealed in a PDP, the increase in the discharge-space voltage at the start of a discharge can be suppressed. Consequently, since the discharge-space voltage is not raised even if the sustain driving voltage is increased by increasing the partial pressure of Xe, the decreasing of lifetime of the protective films can be suppressed.

Figure 16:
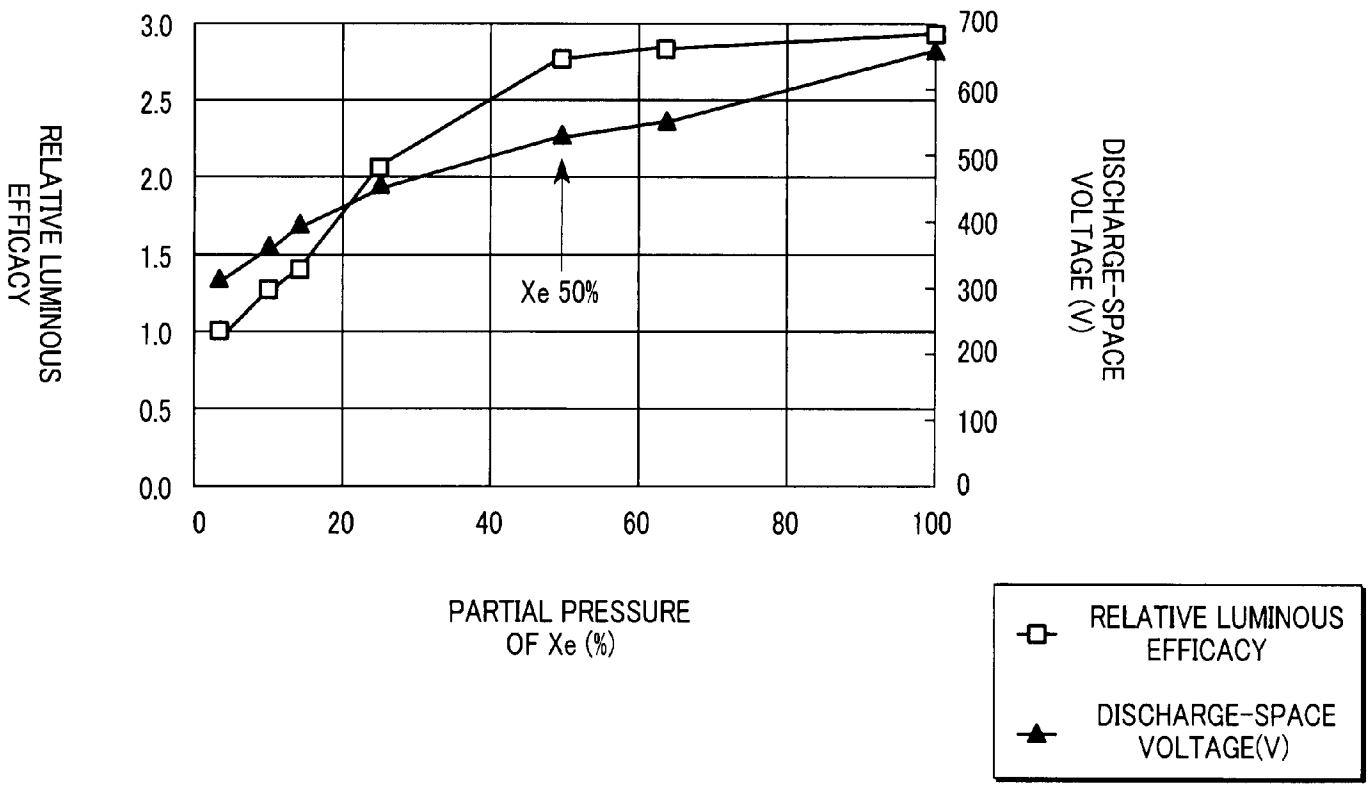
FIG. 16 is a graph showing a relationship between luminous efficacy and a partial pressure of Xe and a relationship between a discharge-space voltage and the partial pressure of Xe.

FIG. 16 is a graph showing a relationship between luminous efficacy and the partial pressure of Xe and a relationship between our estimated discharge-space voltage and the partial pressure of Xe, based on "High Efficacy PDP," SID 03, pp. 28-31. This graph shows that as the partial pressure of Xe is increased, the luminous efficacy is improved, and at the same time the discharge-space voltage is also increased. While the discharge-space voltage is increased even in a range of above 50% of Xe, the luminous efficacy intends to saturate, and a disadvantage of increasing voltages becomes greater. Therefore it is desirable that the partial pressure of Xe is selected to be equal to or lower than 50% for the purpose of improving luminous efficacy minimizing the sputter-induced deteriorations of the protective films due to the increase in the discharge-space voltage.

A relationship between the depth of sputtering-caused depressions in the protective films and the discharge-space voltages was studied by using PDPs having a discharge gas of Ne—Xe 5% and 500 Torr sealed therein, and the result obtained was 2.5 nm/V.

Assume that the decreasing of protective-film-derived lifetime obtainable by the presently used PDPs employing a 5%-Xe discharge gas is acceptable to 5%. Since the discharge-space voltage of the presently used PDPs is about 320 V, the maximum acceptable increase in the discharge-space voltage is 16V. FIG. 16 indicates that this value corresponds to the partial pressure 6.5% of Xe, and therefore the below-described countermeasures are effective for the partial pressures of Xe equal to or higher than 6.5%. The useful partial pressure of Xe is summarized such that the below-described countermeasures are effective for the partial pressures of Xe in a range of from 6.5% to 50%.

However, as described in the above-cited JP 2005-10398 A, the two-step discharge driving method requires the lengthening of the repetition period of sustain pulses for the purpose of stabilizing of discharges. In PDPs, a load factor is defined as a ratio of the number of lighted discharge cells at a given point of time to the number of all the discharge cells included in the panel. However, in some cases, the load factor is defined as a ratio of the number of lighted discharge cells at a given point of time among discharge cells arranged in a given line in a direction of an extension of sustain electrode pairs, to the number of all the discharge cells arranged in the line.

In the case of PDPs, an APC (Automatic Power Control) is used for the purpose of keeping power consumption below a certain value for a display of a large load factor. The APC increases the number of sustain pulses as the load factor decreases, for the purpose of keeping power consumption below a certain value. As a result, in displays of smaller load factors, the frequency of ion sputtering from the protective films is increased, and the protective films are more susceptible to the decreasing of lifetime, the image sticking and others. Therefore, for the purpose of reducing the decreasing of lifetime of the protective films, the image sticking and others, especially in the case of displays of small load factors, it is important to lower the discharge-space voltage at the start of a discharge.

However, in the case of displays of small load factors, since the number of sustain pulses needs to be increased, the two-step discharge driving method cannot be employed which has the sustain pulse repetition period lengthened for the purpose of stable driving. Therefore, in a case where the two-step discharge driving method is employed in displays of small load factors, it is necessary to achieve stable driving without lengthening the sustain pulse repetition period. It was found out that stable driving without increasing the sustain pulse repetition period can be realized by selecting the pre-discharge voltage Vp to be equal to or higher than a specific voltage Vpmin. That is to say, in a case where a sustain pulse repetition period is equal to or shorter than 13 μs, the minimum value Vpmin of the pre-discharge voltage Vp capable of a stable two-step discharge driving is specified by the following conditions:

$$Vp\min \leqq Vp < Vs,\ Vp\min = 2\ Vs\min - Vs - \alpha,$$

where α is determined based upon a structure of discharge cells and a method of driving the discharge cells.

Here, the sustain pulse repetition period is a repetition period with which a pair of sustain pulses applied to X and Y electrodes, respectively, is repeated. Vsmin is the minimum sustain-maintaining voltage for displays of various load factors (in many cases, a display of white over the entire display area) when the sustain voltage Vs is lowered with Vp=Vs. The minimum sustain-maintaining voltage is the minimum sustain voltage capable of producing flicker-free normal displays in the image displays.

Figure 17:
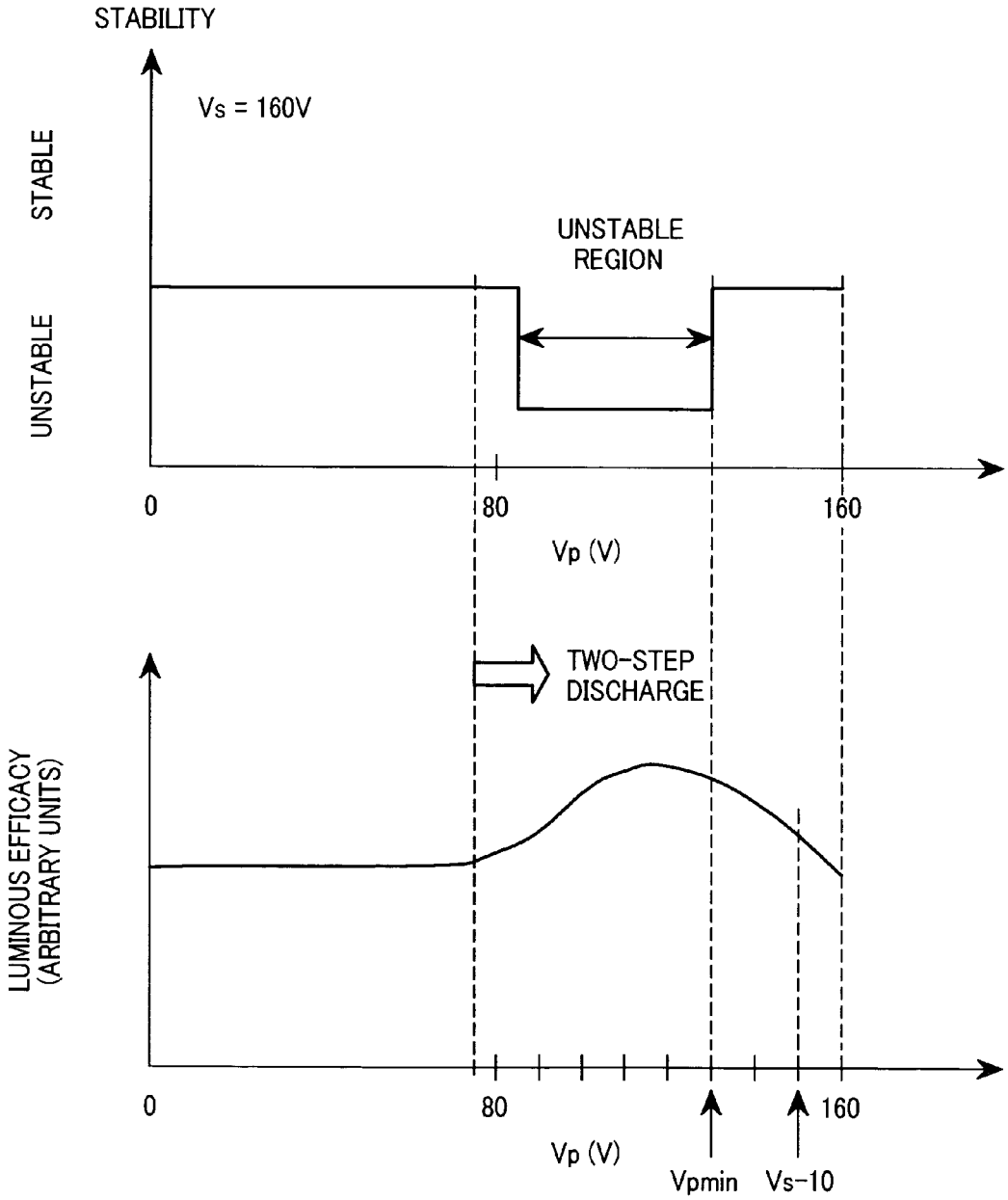
FIG. 17 is a graph showing a sustain pulse repetition period, and a stable-discharge region versus Vp.

The conditions specified by the above formulas are effective especially for cases where the sustain pulse repetition period is equal to or shorter than 13 μs. However, since the pre-discharge period Tp sometimes needs to be as long as 1 μs, and the sustain-pulse-applied period Ts needs to be at least 1 μs for a main discharge, half the sustain pulse repetition period, Tf/2, is at least 2 μs, and therefore the sustain pulse repetition period Tf needs to be equal to or longer than 4 μs. Therefore the conditions specified by the above formulas are effective for the sustain pulse repetition periods especially in a range of from 4 μs to 13 μs. Further, since the sustain-pulse-applied period Ts is a period for storing wall charges after completion of the main discharge, it is desirable to select the sustain-pulse-applied period Ts to be equal to or longer than 2 μs, and therefore it is desirable to select the sustain pulse repetition period Tf to be 6 μs or longer. Therefore, the conditions specified by the above formulas are more effective for cases where the sustain pulse repetition periods are in a range of from 6 μs to 13 μs. FIG. 17 is a graph showing the sustain pulse repetition period, and a stable-discharge region versus Vp, where Vs=180 V, and Vsmin=160V.

The inequality Vp<Vs is specified because in a case where Vp=Vs, the driving waveform is the same as that of the conventional driving method, and therefore the decreasing of lifetime of the protective films, image sticking and others cannot be reduced or suppressed. Further, another reason is that the improvement in luminous efficacy provided by the two-step discharge driving method cannot be expected. Further, it is preferable that the inequality Vp<Vs−10 is satisfied to further reduce or suppress the decreasing of lifetime of the protective films and image sticking, and to improve luminous efficacy further.

α included in the above equation for determining Vpmin depends on a structure of discharge cells and a method of driving the discharge cells.

In Embodiment 1 employing the double-slit driving by using the above-mentioned regular and reverse slits and a straight-rib structure, discharges are susceptible to instability due to crosstalk-induced unwanted discharges occurring in reverse slits, the present inventors have found out that Vp needs to be selected to be comparatively high. In a case where a PDP having a discharge gas of Ne—Xe 5% and 500 Torr sealed therein was driven by using a conventional sustain waveform having the sustain pulse repetition period of 7 μs and the pre-discharge period Tp of 0.7 μs, Vsmin turned out to be 150 V.

FIG. 17 is a graph showing discharge stability and a pre-discharge voltage Vp dependency of luminous efficacy for a case where the two-step discharge driving waveform shown in FIG. 1 was employed as a sustain waveform, and the sustain voltage Vs is selected to be 160 V. FIG. 17 shows that as Vp is increased from 0 V to Vs (=160 V), a discharge becomes instable in a certain region, and the discharge becomes stable again when Vs is increased further. FIG. 17 also shows that the luminous efficacy begins to increase in the vicinity of Vp=80 V, then reaches a peak at a certain value of Vp, and then at Vp=Vs=160 V, returns to a luminous efficacy value obtainable by the conventional driving method with Vp=0 V. Strictly speaking, however, the luminous efficacy curve cannot be measured in a region of Vp where discharges are instable, and therefore the luminous efficacy was measured in a condition where flicker occurs in a display, and therefore the luminous efficacy curve was obtained by adding some presumptions.

In FIG. 17, Vpmin is 130 V. By using Vsmin and Vs, there is obtained, $$\begin{aligned} Vpmin &= 2\ Vsmin - Vs - \alpha \\ &= 2 \times 150 - 160 - \alpha \\ &= 140 - 10, \end{aligned}$$

Solving for α gives

α=10 V.

To sum up, the stable two-step discharge can be obtained by selecting Vp to satisfy the following formulas:

$$Vp\min \leqq Vp < Vs,\ Vp\min = 2\ Vs\min - Vs - 10.$$

Further, for the purpose of further reducing or suppressing the decreasing of lifetime of the protective films, image sticking and others, and improving the luminous efficacy, it is desirable to satisfy the following:

$$Vp < Vs - 10.$$

With the above-explained configuration, since the pre-discharge is generated in a state of the low discharge-space voltage during the pre-discharge period in which Vp is applied, advantages are provided which are capable of lengthening the lifetime of the protective films and reducing or suppressing image sticking.

Figure 4A:
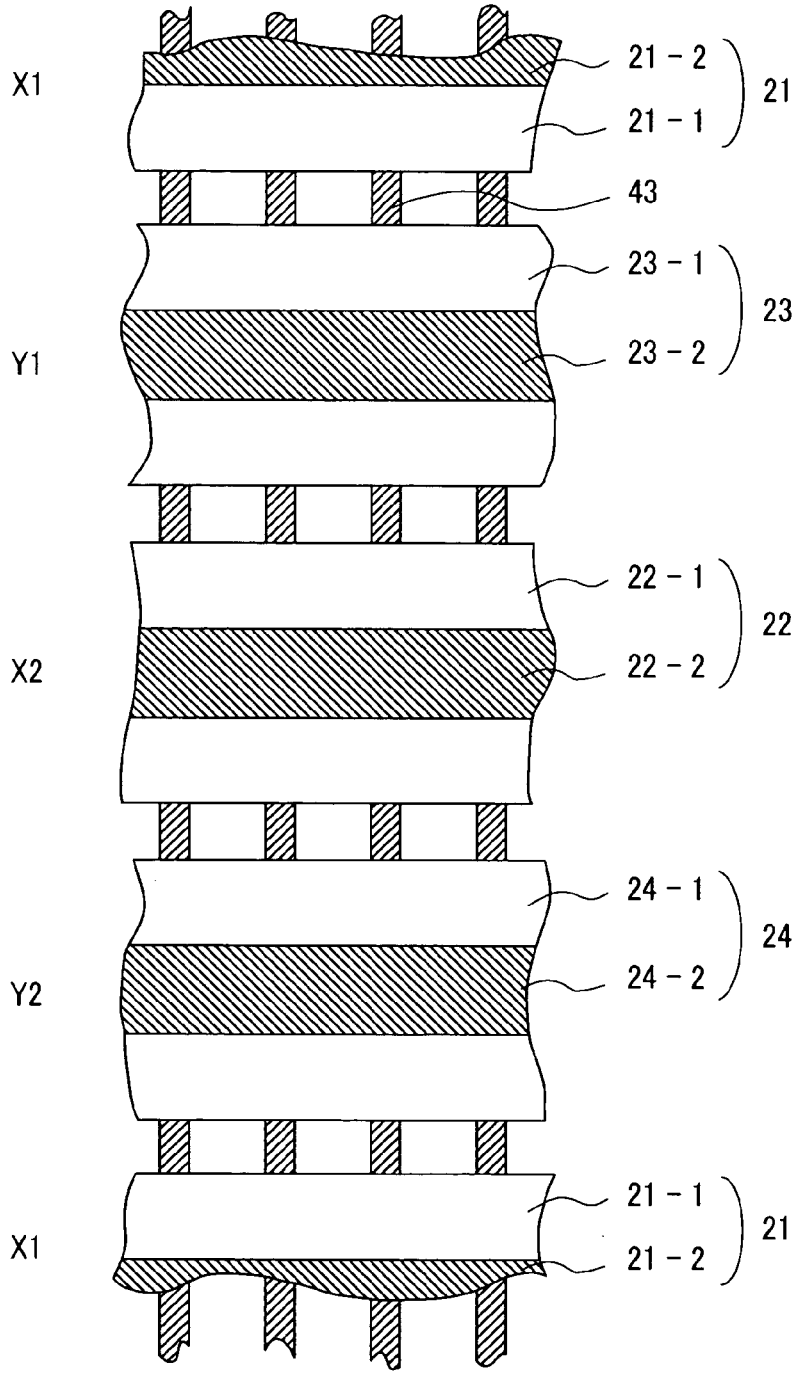
FIG. 4(*a*) is a plan view of a box rib and electrodes used in an ac three-electrode surface-discharge type PDP of an example of Embodiment 1, viewed from the direction corresponding to the direction D3 depicted in FIG. 10.
Figure 4B:
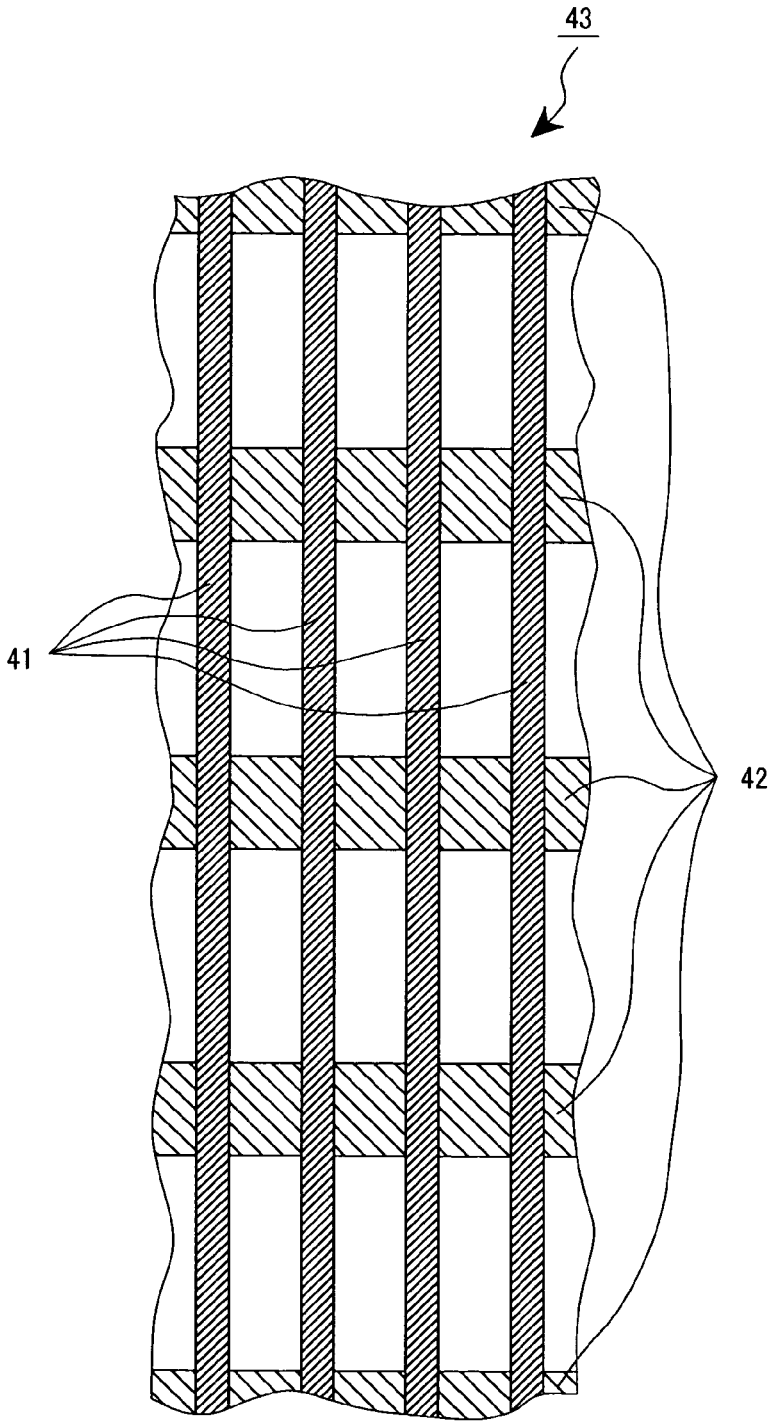

FIGS. 4(*a*) and 4(*b*) are illustrations for explaining an example employing a box rib 43 as rib members for separating discharge cells from each other in the ac three-electrode surface-discharge type PDP in accordance with Embodiment 1. FIG. 4(*a*) is a plan view of a rib 43 and electrodes 21-24 of the ac three-electrode surface-discharge type PDP of this example viewed from a direction corresponding to the direction D3 depicted in FIG. 10, and FIG. 4(*b*) is a plan view of the box rib 43 only, viewed from a direction corresponding to the direction D3 depicted in FIG. 10. The box rib 43 differs from the above-explained straight ribs 31 in that the box rib 43 comprises longitudinal ribs 41 and lateral ribs 42 for separating adjacent discharge cells from each other. The arrangement of electrodes within the panel of the ac three-electrode surface-discharge type PDP of this example of the present invention, the basic configuration of driving circuits of this example, and the discharges of this example are similar to those illustrated in FIG. 2. A driving method for this example is the same as that for the straight rib structure. However, while discharges in the straight-rib type PDP extend into adjacent slits between the electrodes, the box-rib type PDP has the lateral ribs 42 and therefore discharges in the box-rib type PDP stop in the vicinities of the lateral ribs 42.

This example employs the double-slit driving by using the above-mentioned regular and reverse slits and the box-rib structure, therefore this example is less subject to occurrences of crosstalk-induced unwanted discharges in reverse slits, compared with the straight-rib structure, and therefore instable discharges do not occur easily.

In a case where a PDP having a discharge gas of Ne—Xe 5% and 500 Torr sealed therein was driven by using a conventional sustain waveform having the sustain pulse repetition period of 7 μs and the pre-discharge period Tp of 0.7 μs, Vsmin turned out to be 150 V.

Figure 18:
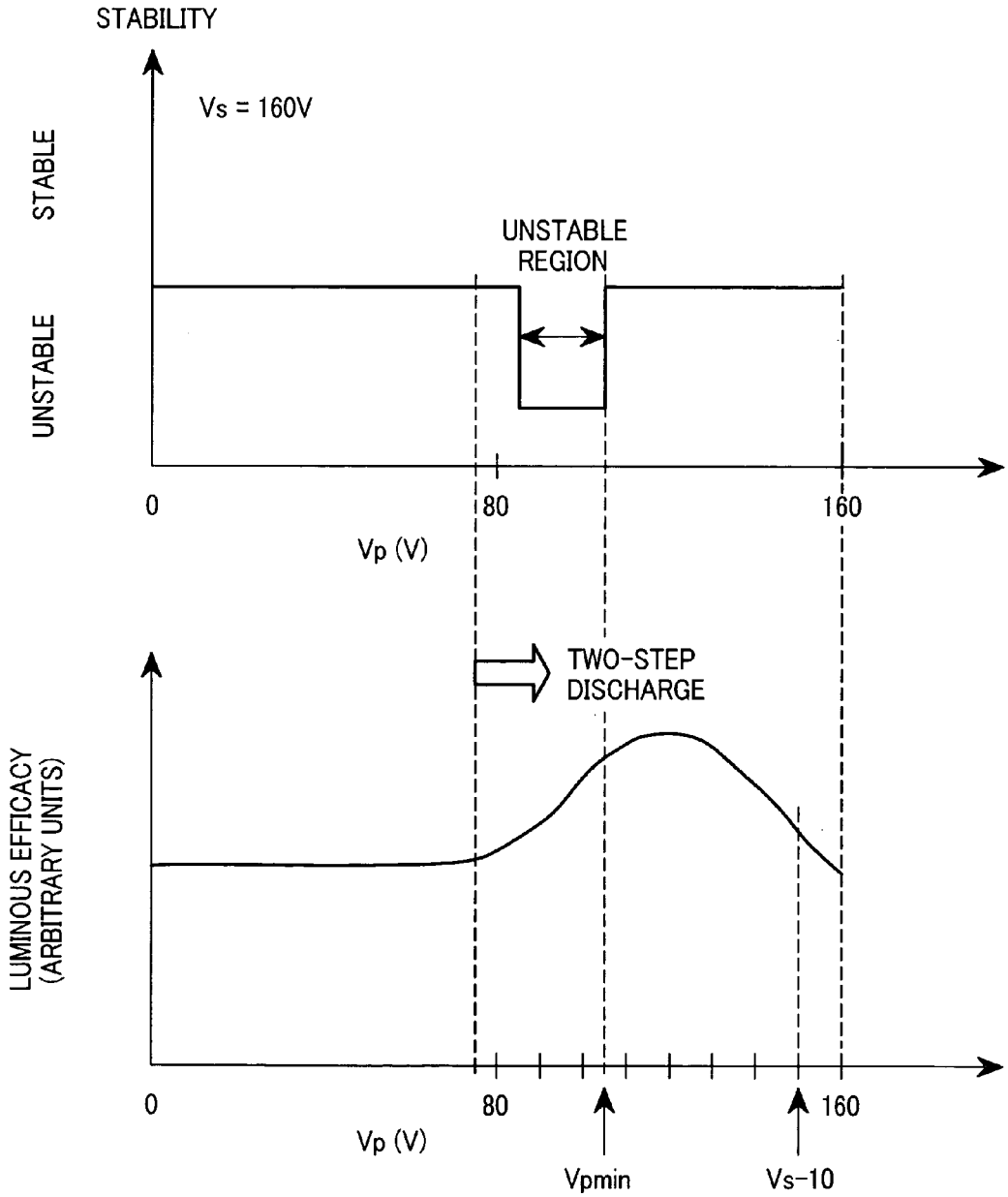
FIG. 18 is a graph showing discharge stability and a pre-discharge-voltage Vp dependency of luminous efficacy for a case where the two-step discharge driving waveform shown in FIG. 1 was employed as a sustain waveform.

FIG. 18 is a graph showing discharge stability and a pre-discharge voltage Vp dependency of luminous efficacy for a case where the two-step discharge driving waveform shown in FIG. 1 was employed as a sustain waveform, and the sustain voltage Vs is selected to be 160 V. FIG. 18 shows that as Vp is increased from 0 V to Vs (=160 V), a discharge becomes instable in a certain region, and the discharge becomes stable again when Vs is increased further. FIG. 18 also shows that the luminous efficacy begins to increase in the vicinity of Vp=80 V, then reaches a peak at a certain value of Vp, and then at Vp=Vs=160 V, returns to a luminous efficacy value obtainable by the conventional driving method with Vp=0 V. Strictly speaking, however, the luminous efficacy curve cannot be measured in a region of Vp where discharges are instable, and therefore the luminous efficacy was measured in a condition where flicker occurs in a display, and therefore the luminous efficacy curve was obtained by adding some presumptions.

In FIG. 18, Vpmin is 105 V. By using Vsmin and Vs, there is obtained, $$\begin{aligned} Vpmin &= 2\ Vsmin - Vs - \alpha \\ &= 2 \times 150 - 160 - \alpha \\ &= 140 - 35. \end{aligned}$$

Therefore, Vp for stabilizing the two-step discharge is selected as follows:

In a case where the sustain pulse repetition period is in a range of from 4 μs to 13 μs, or in a range of from 6 μs to 13 μs, Vpmin is defined as the pre-discharge voltage Vp capable of stabilizing the two-step discharge, and Vpmin is selected to satisfy the following formulas:

$$Vp\text{min} \leqq Vp < Vs,\ Vp\text{min} = 2\ Vs\text{min} - Vs - \alpha,$$

where $\alpha$=35 V.

Further, for the purpose of further reducing or suppressing the decreasing of lifetime of the protective films, image sticking and others, and improving the luminous efficacy, it is desirable to satisfy the following:

$$Vp < Vs - 10.$$

The above condition is effective especially in a case where the sustain pulse repetition period is equal to or shorter than 13 μs.

Since the above-explained conditions can make stable the sustain discharges having the sustain pulse repetition period in a range of from 4 μs to 13 μs or in a range of from 6 μs to 13 μs which are preceded by the pre-discharges, the sputtering from the protective films can be reduced even in a small-load-factor display utilizing a large number of sustain pulses. Consequently, this example can lengthen the lifetime of the protective films compared with the sustain discharges not preceded by the pre-discharges.

Especially in PDPs having a discharge gas sealed therein containing a high proportion of Xe in a range of from 6.5% to 50%, the decreasing of lifetime of the protective films can be suppressed which is due to a required increase in the sustain voltage.

The above-explained shapes of the, electrodes and box rib are only examples, and the present invention is not limited to the above-explained shapes.

Embodiment 2

Figure 5:
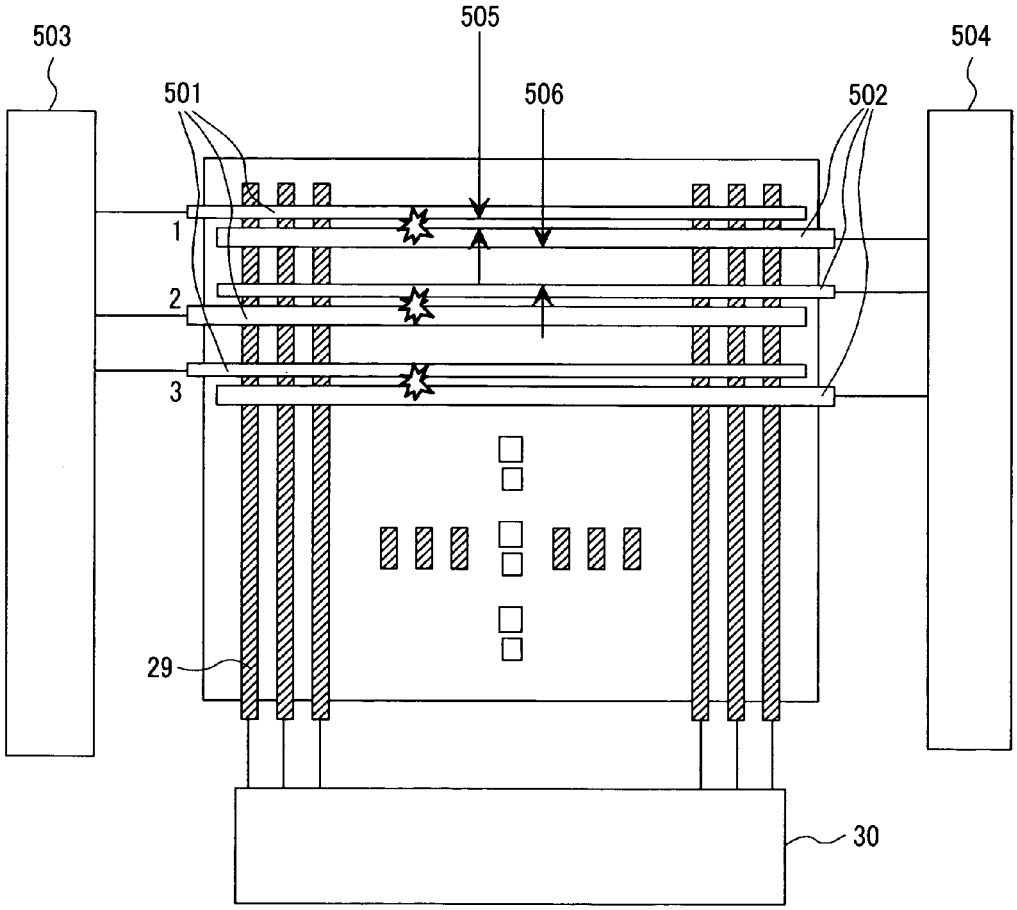
FIG. 5 illustrates an arrangement of electrodes within a panel of an ac three-electrode surface-discharge type PDP in accordance with Embodiment 2 of the present invention, a basic configuration of a driving circuit thereof, and discharges.
Figure 6A:
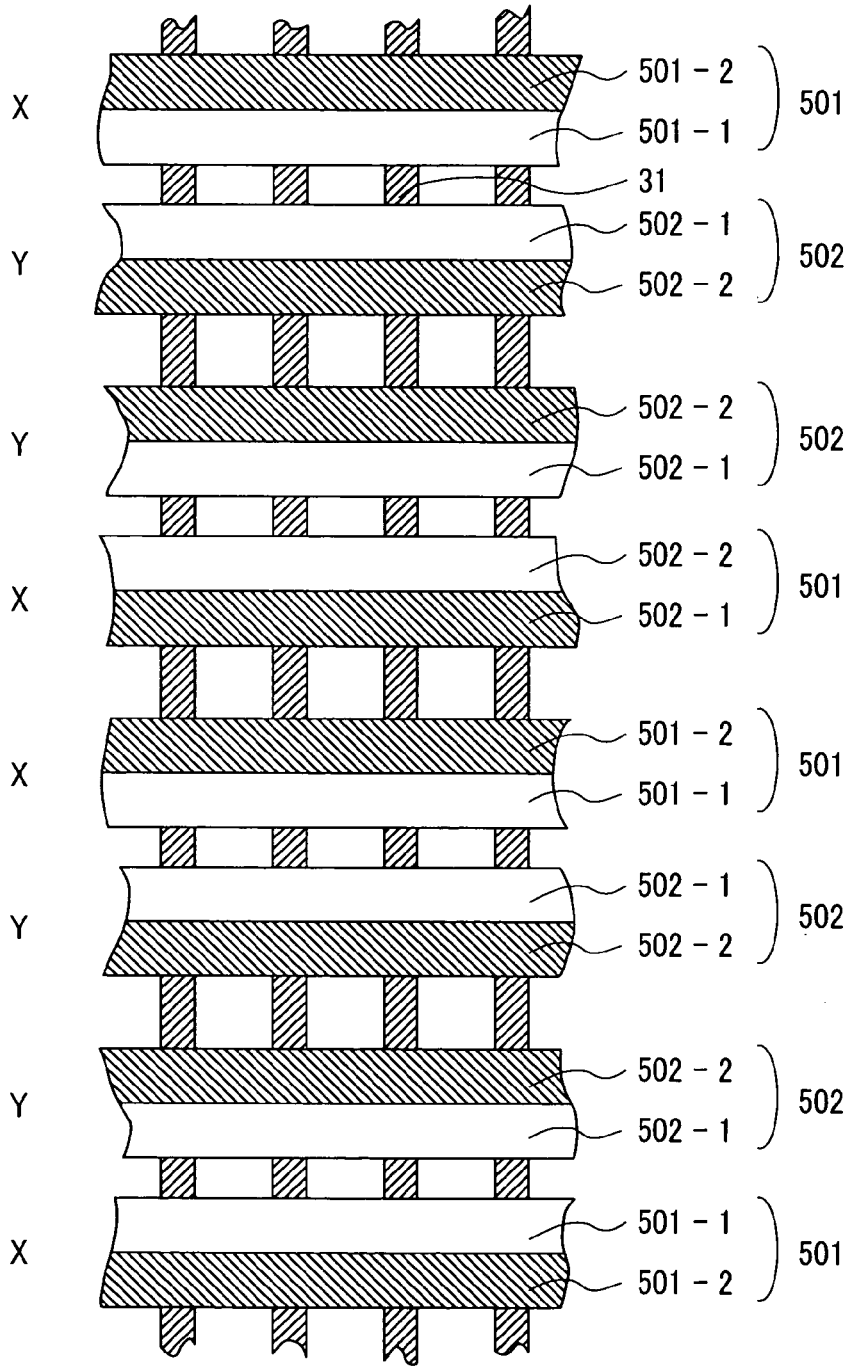
FIG. 6(*a*) is a plan view of straight ribs and electrodes used in an ac three-electrode surface-discharge type PDP of Embodiment 2, viewed from the direction corresponding to the direction D3 depicted in FIG. 10.
Figure 6B:
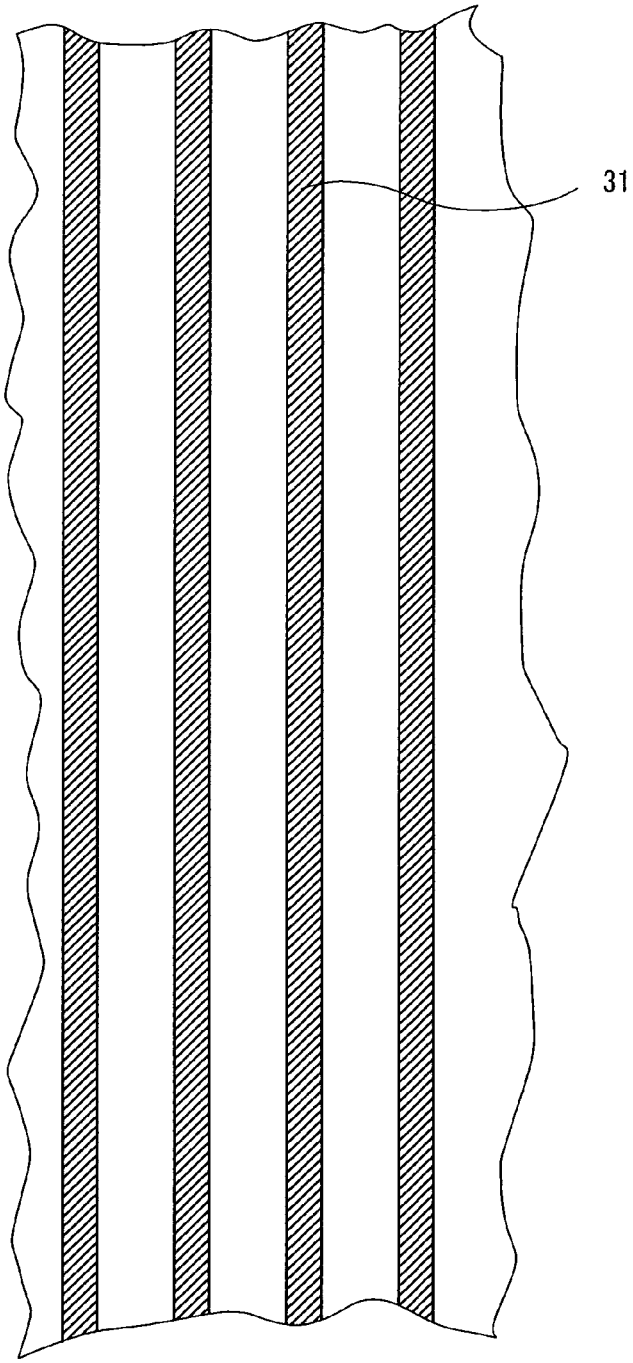

FIG. 5 illustrates an arrangement of electrodes within an ac three-electrode surface-discharge type PDP in accordance with Embodiment 2 of the present invention, a basic configuration of a driving circuit thereof, and light emissions generated by discharges. FIGS. 6(*a*) and 6(*b*) are illustrations for explaining an example using straight ribs 31 as rib members for separating discharge cells from each other in the ac three-electrode surface-discharge type PDP of Embodiment 2 of the present invention. FIG. 6(*a*) is a plan view of the straight ribs 31 and electrodes 501-502 of the ac three-electrode surface-discharge type PDP of Embodiment 2, viewed from a direction corresponding to the direction D3 depicted in FIG. 10, and FIG. 6(*b*) is a plan view of the straight ribs 31 only, viewed from a direction corresponding to the direction D3 depicted in FIG. 10. Each of the X electrodes 501 comprises an X transparent electrode 501-1 and a bus electrode 501-2, and each of the Y electrodes 502 comprises a Y transparent electrode 502-1 and a bus electrode 502-2.

Figure 15A:
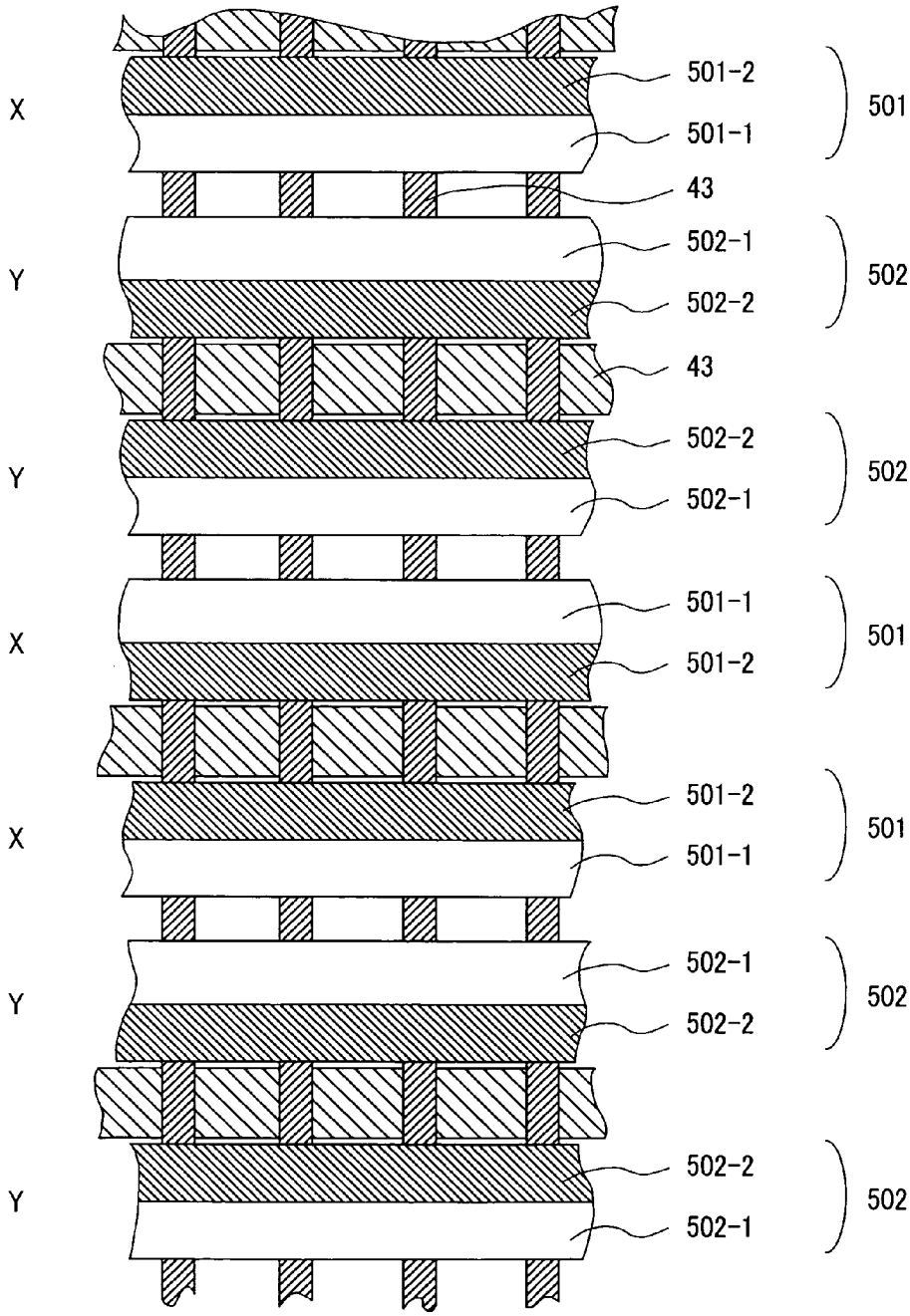
FIG. 15(*a*) is a plan view of box rib and electrodes used in the ac three-electrode surface-discharge type PDP of Embodiment 2, viewed from the direction corresponding to the direction D3 depicted in FIG. 10.
Figure 15B:
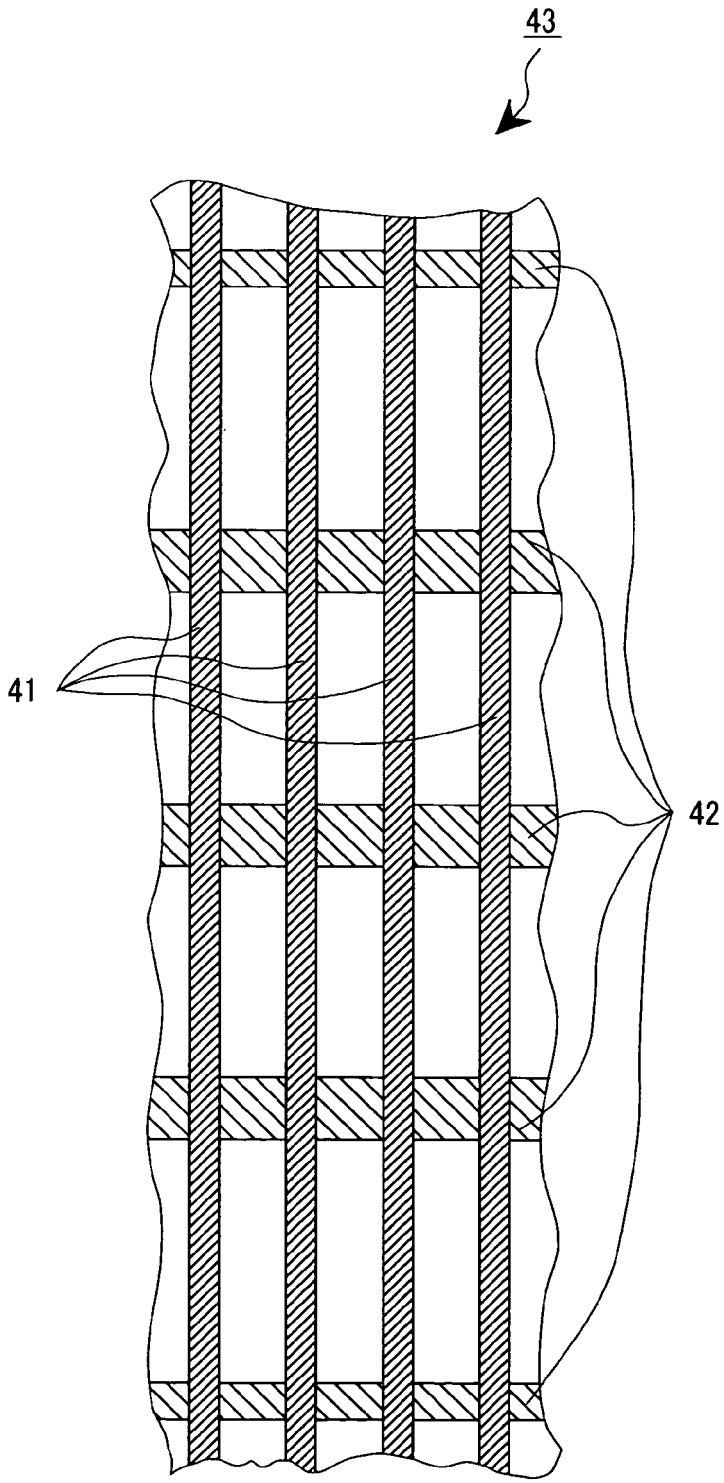

On the other hand, FIGS. 15(*a*) and 15(*b*) are illustrations for explaining an example using a box rib 43 as rib members for separating discharge cells from each other in the ac three-electrode surface-discharge type PDP of Embodiment 2 of the present invention. FIG. 15(*a*) is a plan view of the box rib 43 and electrodes 501-502 of the ac three-electrode surface-discharge type PDP of Embodiment 2, viewed from a direction corresponding to the direction D3 depicted in FIG. 10, and FIG. 15(*b*) is a plan view of the box rib 43 only, viewed from a direction corresponding to the direction D3 depicted in FIG. 10. The box rib 43 comprises longitudinal ribs 41 and lateral ribs 42 intersecting the longitudinal ribs 41 at approximately right angles. The difference in height between the lateral ribs 42 and the longitudinal ribs 41 is 3μ or more.

Each of the X electrodes 501 comprises an X transparent electrode 501-1 and a bus electrode 501-2, and each of the Y electrodes 502 comprises a Y transparent electrode 502-1 and a bus electrode 502-2.

As shown in FIG. 5, the ac three-electrode surface-discharge type PDP of Embodiment 2 of the present invention comprises X electrodes 501, Y electrodes 502, an X driving circuit 503, a Y driving circuit 504,A electrodes (address electrodes) 29, and an address circuit 30. Gaps between X and Y electrodes for generating discharges are called regular slits 505, and gaps between X and Y electrodes for not generating discharges are called reverse slits 506. The X electrodes 501 and the Y electrodes 502 are supplied with drive voltages from the X sustain circuit 503 and the Y driving circuit 504, respectively. The address electrodes 29 are supplied with driving voltages from the address driving circuit 30.

One field of 1/60 seconds forming one picture is divided into 10 subfields for producing gray scale representation. One subfield comprises a reset period, an address period and a sustain period as in the case of a conventional driving. The PDP of Embodiment 2 is driven by using progressive scanning.

As shown in FIG. 14(*b*), during the address period of each of the subfields, the A electrodes 29 supplied with a voltage from the address driving circuit 30 receive a pulse voltage denoted by reference numeral 82, the X1 or X2 electrodes are supplied with a voltage denoted by reference numeral 83, the Y1 or Y2 electrodes are supplied with pulse voltages denoted by reference numerals 84-87, and as a result, wall charges are accumulated in discharge cells desired to be lighted during the sustain period.

Figure 7:
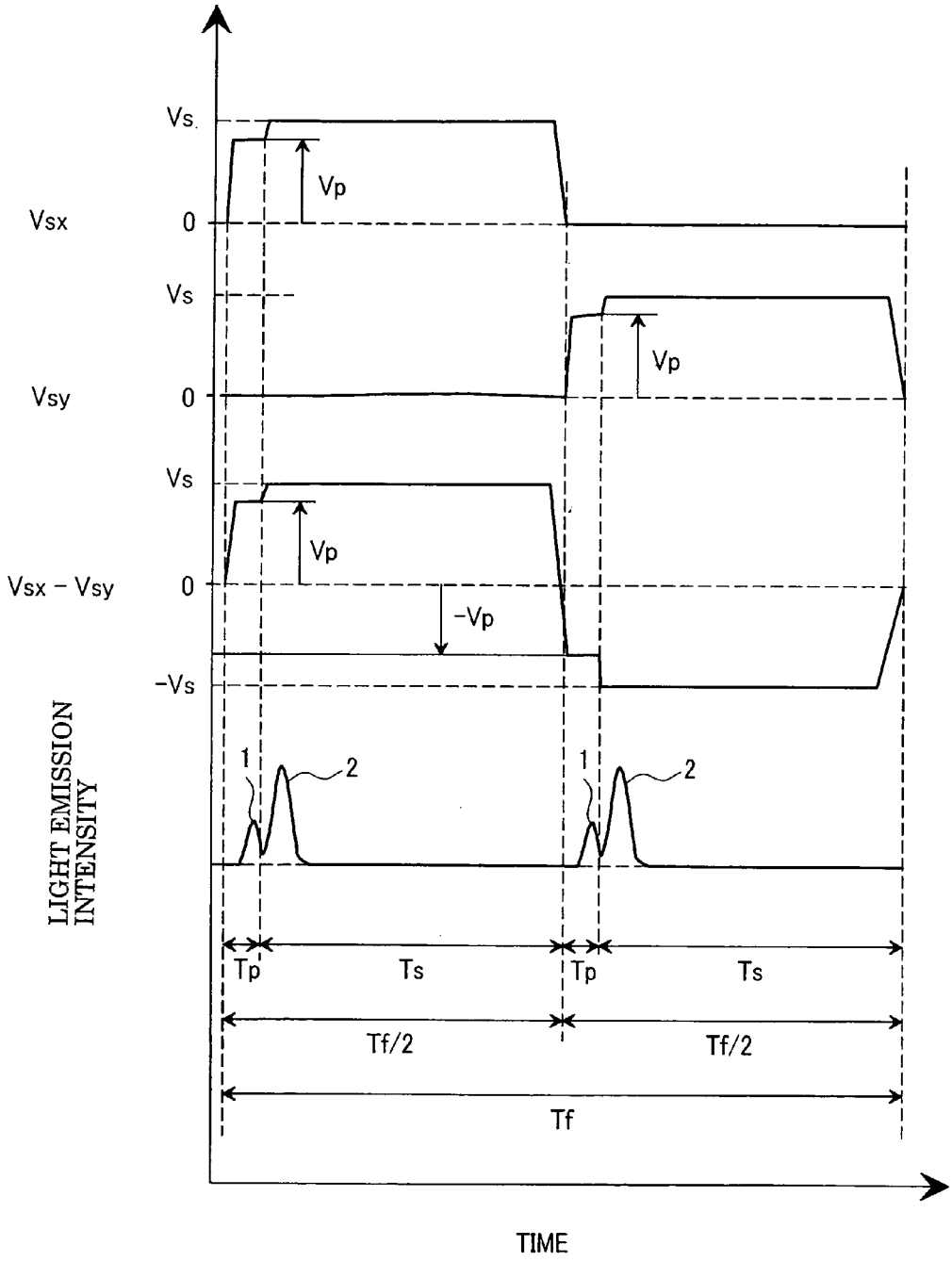
FIG. 7 illustrates sustain pulse waveforms (Vsx, Vsy) applied to sustain electrodes (X electrodes and Y electrodes) during a sustain period of the plasma display device in accordance with Embodiment 2 of the present invention, a waveform of a difference (Vsx−Vsy), and a waveform of light emission intensity during one sustain repetition period Tf.

FIG. 7 illustrates sustain pulse waveforms (Vsx, Vsy) applied to the sustain electrodes (the X electrodes 501 and the Y electrodes 502) during the sustain period 81 (see FIG. 14(*a*)) of the plasma display device in accordance with Embodiment 2 of the present invention, a waveform of the difference (Vsx−Vsy), and a waveform of light emission during one sustain repetition period Tf. The address voltage is always kept at ground potential during the sustain period.

As shown in FIG. 7, one repetition period Tf of the sustain period comprises at least a pre-discharge period Tp and a sustain-pulse-applied period Ts. In the former half, Tf/2, of the repetition period, Vp is applied to the sustain electrodes during the pre-discharge period Tp of Vsx, and Vs is applied to the sustain electrodes during the sustain-pulse-applied period Ts. Vsy is kept at ground potential during this period.

Therefore the difference (Vsx−Vsy) is Vp during the pre-discharge period Tp, and is Vs during the sustain-pulse-applied period Ts.

During the latter half, Tf/2, of the repetition period, the relationship between Vsx and Vsy is reversed, the difference (Vsx−Vsy) is −Vp during the pre-discharge period Tp, and is −Vs during the sustain-pulse-applied period Ts. With the above voltages applied, a pre-discharge 1 is generated between the sustain electrodes during the pre-discharge period Tp, and thereafter a main discharge 2 is generated in the sustain-pulse-applied period Ts.

In Embodiment 2, the discharges are generated by the regular slits only, and therefore this driving is called the regular slit driving. It was confirmed that luminous efficacy is improved by producing the sustain discharges following the above-described pre-discharges compared with that obtained by conventional discharges without the pre-discharges.

In a case where a sustain pulse repetition period is equal to or shorter than 13 μs, the minimum value Vpmin of the pre-discharge voltage Vp capable of a stable two-step discharge driving is specified by the following conditions:

$$Vp\min \leqq Vp,\ Vp\min = 2\ Vs\min - Vs - \alpha,$$

where α is determined based upon a structure of discharge cells and a method of driving the discharge cells.

The PDP of Embodiment 2 employing the regular slit driving and a straight or box rib structure is less susceptible to discharge instability due to crosstalk-induced unwanted discharges occurring in reverse slits than in the case of the straight rib structure in Embodiment 1. Further, the box rib structure is less susceptible to occurrences of the above unwanted discharges than the straight rib structure. Therefore for the straight rib structure, α is selected to be 25 V.

In a case where a PDP having a discharge gas of Ne—Xe 5% and 500 Torr sealed therein was driven by using a conventional sustain waveform having the sustain pulse repetition period of 7 μs and the pre-discharge period Tp of 0.7 μs, Vsmin turned out to be 150 V.

Figure 19:
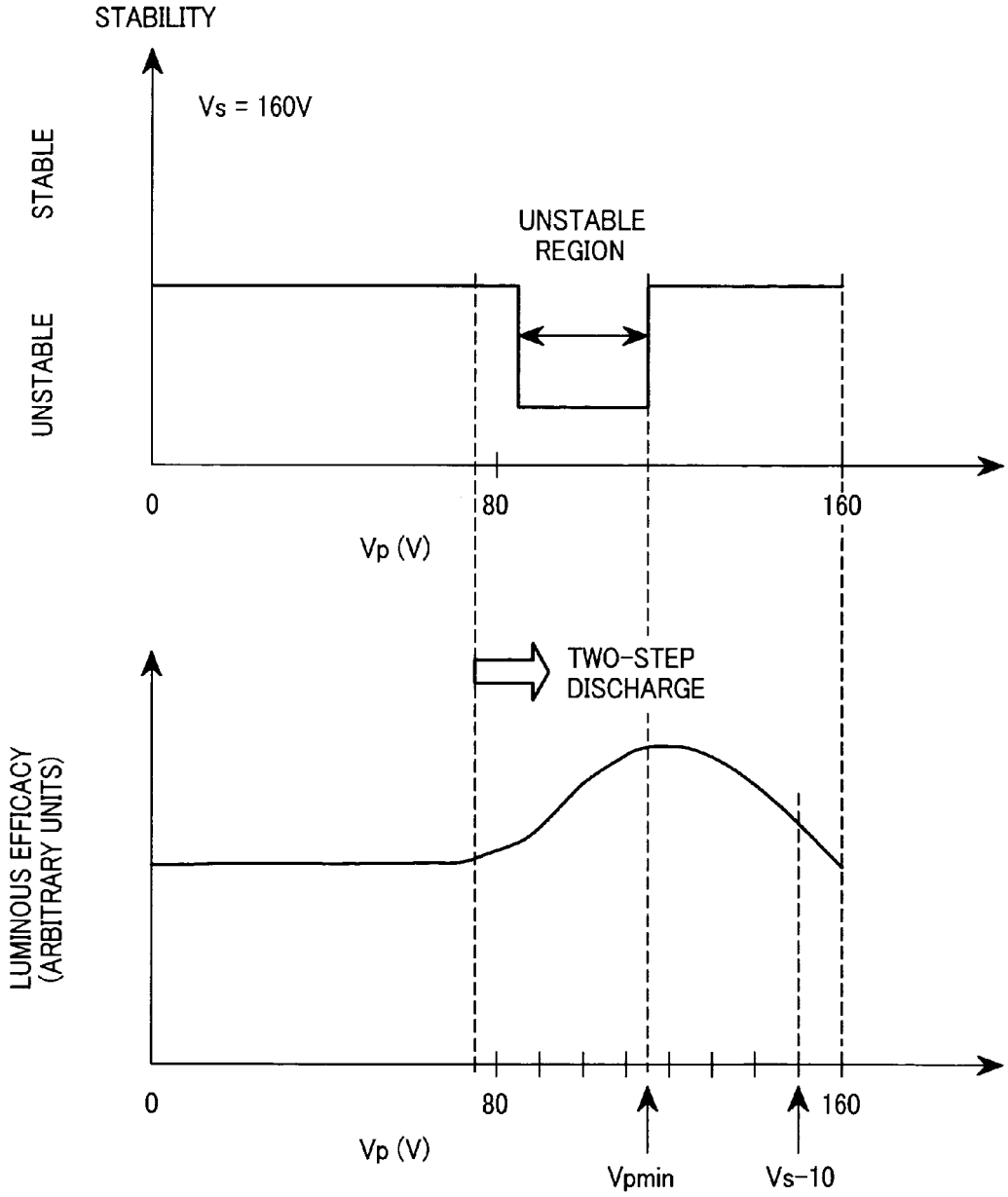
FIG. 19 is a graph showing discharge stability and a pre-discharge-voltage Vp dependency of luminous efficacy for a case where the two-step discharge driving waveform shown in FIG. 1 was employed as a sustain waveform.

FIG. 19 is a graph showing discharge stability and a pre-discharge voltage Vp dependency of luminous efficacy for a case where the two-step discharge driving waveform shown in FIG. 1 was employed as a sustain waveform, and the sustain voltage Vs is selected to be 160 V.

In FIG. 19, Vpmin is 115 V. By using Vsmin and Vs, there is obtained, $$\begin{aligned} Vpmin &= 2\ Vsmin - Vs - \alpha \\ &= 2 \times 150 - 160 - \alpha \\ &= 140 - 25. \end{aligned}$$

Therefore, Vp for stabilizing the two-step discharge is selected as follows:

In a case where the sustain pulse repetition period is in a range of from 4 μs to 13 μs, or in a range of from 6 μs to 13 μs, Vpmin is defined as the pre-discharge voltage VP capable of stabilizing the two-step discharge, and Vpmin is selected to satisfy the following formulas:

$$Vp\min \leqq Vp < Vs,\ Vp\min = 2\ Vs\min - Vs - \alpha,$$

where α=25 V.

Further, for the purpose of further reducing or suppressing the decreasing of lifetime of the protective films, image sticking and others, and improving the luminous efficacy, it is desirable to satisfy the following:

$$Vp < Vs - 10.$$

Further, in a case where a PDP having a discharge gas of Ne—Xe 5% and 500 Torr sealed therein and employing the box rib was driven by using a conventional sustain waveform having the sustain pulse repetition period of 7 μs and the pre-discharge period Tp of 0.7 μs, Vsmin turned out to be 150 V.

Figure 20:
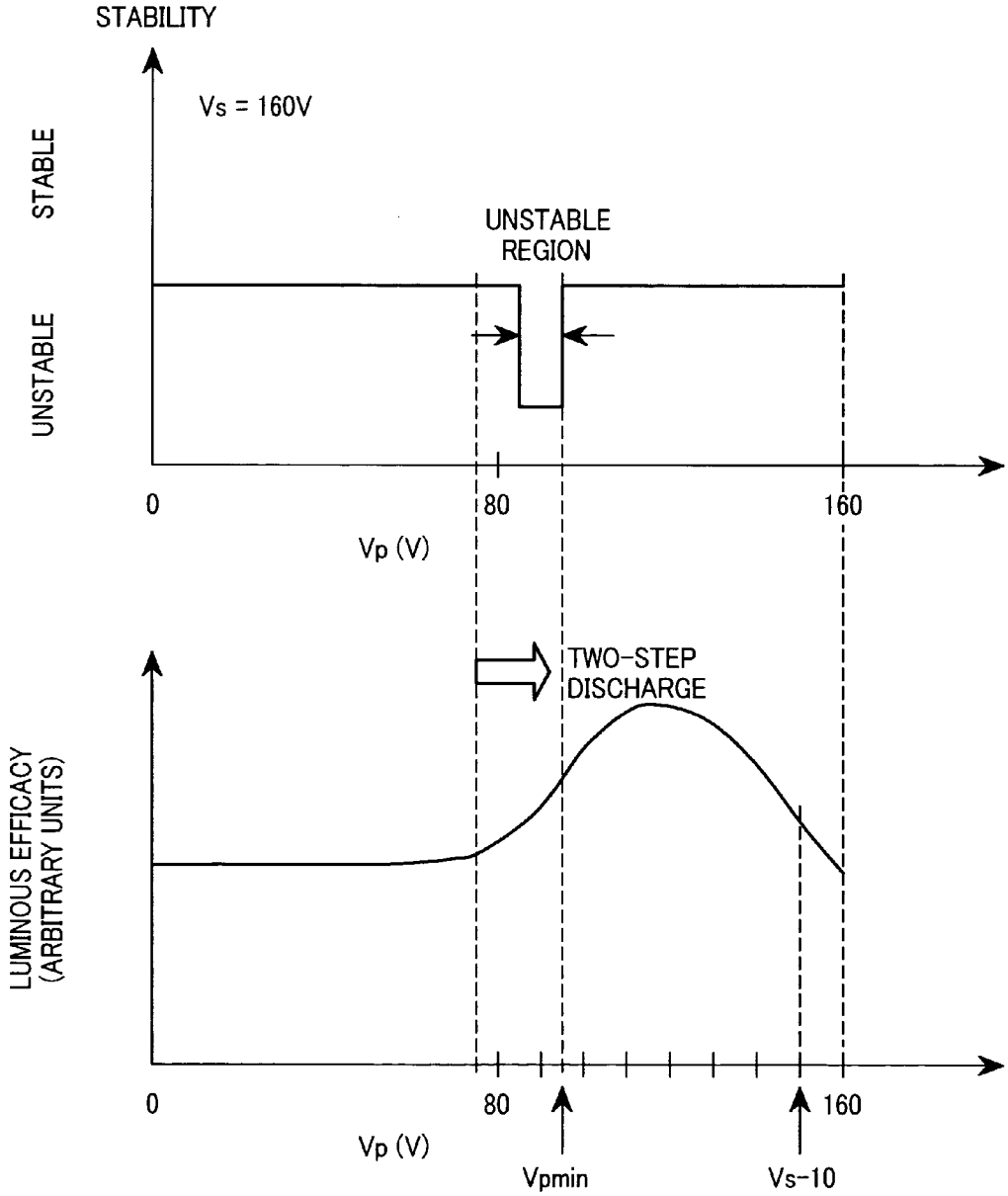
FIG. 20 is a graph showing discharge stability and a pre-discharge-voltage Vp dependency of luminous efficacy for a case where the two-step discharge driving waveform shown in FIG. 1 was employed as a sustain waveform.

FIG. 20 is a graph showing discharge stability and a pre-discharge voltage Vp dependency of luminous efficacy for a case where the two-step discharge driving waveform shown in FIG. 1 was employed as a sustain wave form, and the sustain voltage Vs is selected to be 160 V.

In FIG. 20, Vpmin is 95 V. By using Vsmin and Vs, there is obtained, $$\begin{aligned} Vpmin &= 2\ Vsmin - Vs - \alpha \\ &= 2 \times 150 - 160 - \alpha \\ &= 140 - 45. \end{aligned}$$

Therefore, by using α=45 V, Vp is selected to satisfy the following:

$$Vp\min \leqq Vp,\ Vp\min = 2\ Vs\min - Vs - 45.$$

Further, for the purpose of further reducing or suppressing the decreasing of lifetime of the protective films, image sticking and others, and improving the luminous efficacy, it is desirable to satisfy the following:

$$Vp < Vs - 10.$$

The above conditions are effective especially in a case where the sustain pulse repetition period is in a range of from 4 μs to 13 μs or in a range of from 6 μs to 13 μs. Here, since the pre-discharge is generated in a state of the low discharge-space voltage during the pre-discharge period in which Vp is applied, advantages are provided which are capable of lengthening the lifetime of the protective films and reducing or suppressing image sticking.

Further, a pre-discharge ratio for a display of a small load factor may be selected to be larger than a pre-discharge ratio for a display of a load factor larger than the small load factor.

Here the pre-discharge ratio is defined as a ratio of an integral of a waveform of a light emission integrated over a time of the pre-discharge to an integral of a waveform of a light emission generated by one sustain pulse voltage in the sustain discharge, or the pre-discharge ratio is defined as a ratio of an integral of a waveform of a discharge current integrated over a time of the pre-discharge to an integral of a waveform of a discharge current generated by one sustain pulse voltage in the sustain discharge. Since the pre-discharge is generated by a low applied voltage, the discharge-space voltage is low. Increasing of the pre-discharge ratio can lower the discharge-space voltage in the former half of the sustain discharge influencing lifetime, thereby providing advantages that the decreasing of lifetime of the protective films is prevented and the protective-film-induced image sticking is reduced. Especially when the above-explained driving is employed for the PDP having its required driving voltage increased because of the increased partial pressure of Xe in the discharge gas (the partial pressure of Xe being selected to be in a range of from 6.5% to 50%), even if the driving voltage is increased as the result of having improved luminous efficacy, the increase in the discharge-space voltage can be suppressed. Consequently, the decreasing of lifetime of the protective films can be prevented.

Embodiment 3

Figure 8:
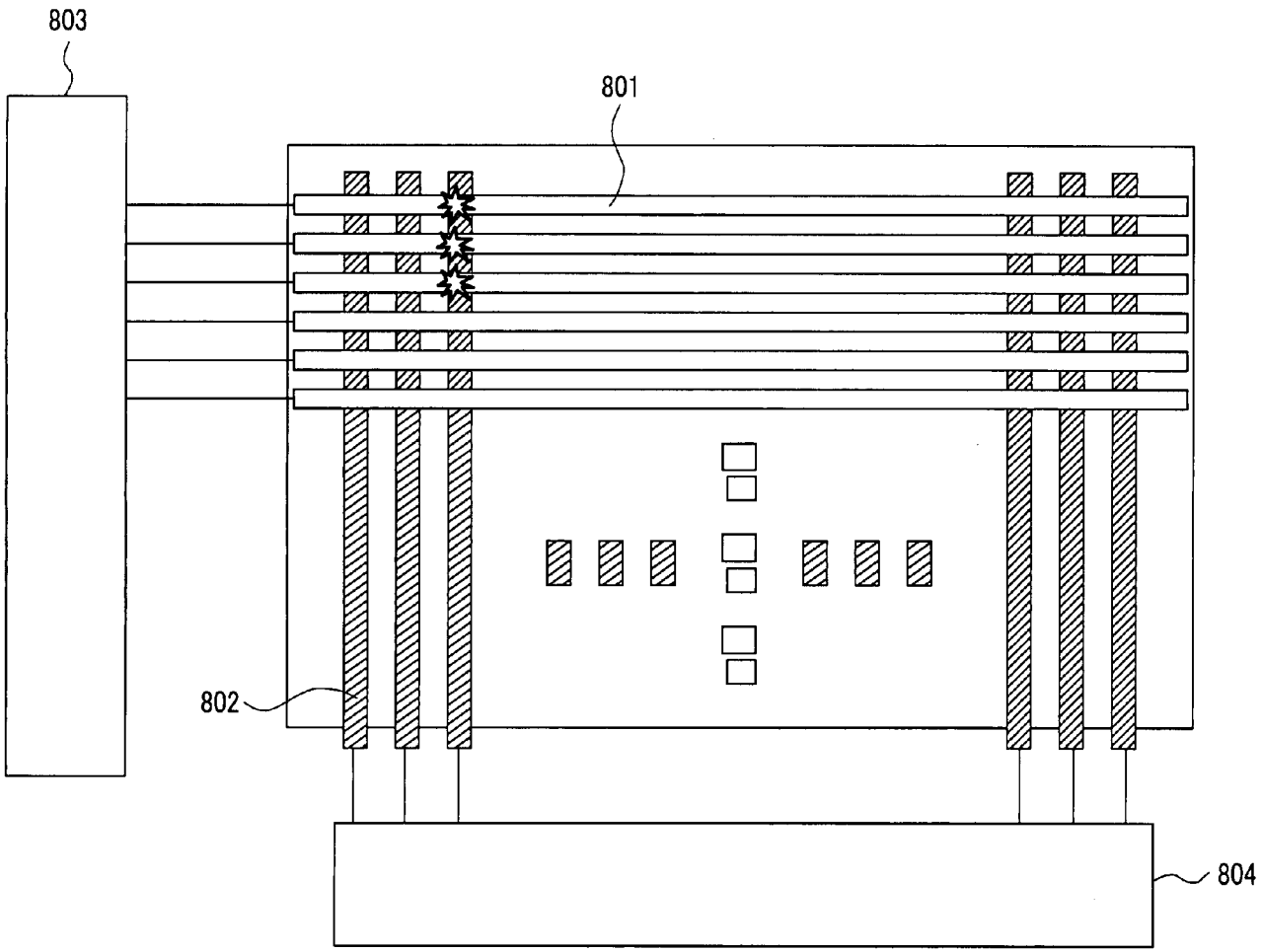
FIG. 8 illustrates an arrangement of electrodes within a panel of an ac two-electrode vertical-discharge type PDP in accordance with Embodiment 3 of the present invention, a basic configuration of a driving circuit thereof, and discharges.
Figure 9:
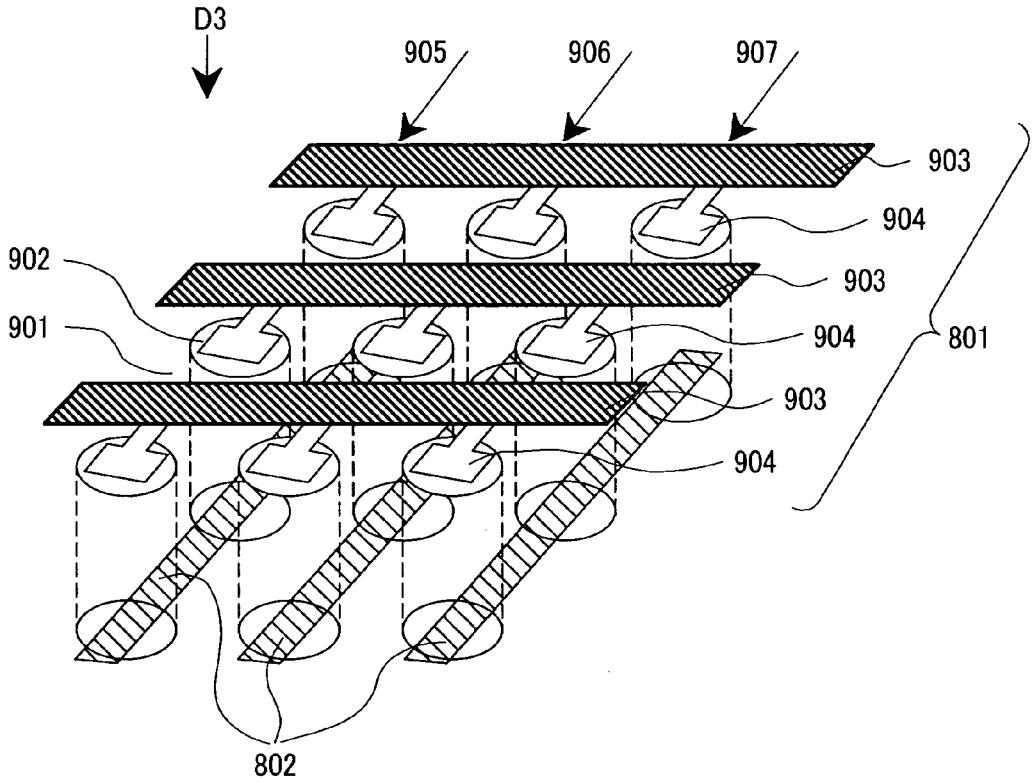
FIG. 9 is a perspective view of ribs and electrodes of the ac two-electrode vertical-discharge type PDP of Embodiment 3.

FIG. 8 illustrates an arrangement of electrodes within the panel of an ac two-electrode vertical-discharge type PDP in accordance with Embodiment 3 of the present invention, a basic configuration of a driving circuit thereof, and light emissions generated by discharges. FIG. 9 is a perspective view of ribs and electrodes of the ac two-electrode vertical-discharge type PDP of Embodiment 3. As shown in FIG. 8, the ac two-electrode vertical-discharge type PDP of Embodiment 3 comprises Y electrodes 801, X electrodes 802, a Y driving circuit 803, and an X driving circuit 804. As shown in FIG. 9, the Y electrodes 801 and X electrodes 802 are disposed to face each other with a rib 901 interposed therebetween. The rib 901 is perforated with holes 902. Discharges are generated between opposing ones of the Y electrodes 801 and the X electrodes 802 through corresponding ones of the holes 902. Each of the Y electrodes 801 comprises a bus electrode 903 and a transparent electrode 904, and the bus electrodes 903 made of low-resistance material are disposed not to block the holes 902 on the rib 901. Each of the X electrodes 802 comprises a bus electrode of low resistance only. The cylindrical sidewalls of the holes 902 arranged in a direction 905 in the rib 901 are coated with red (R) phosphors, the cylindrical sidewalls of the holes 902 arranged in a direction 906 in the rib 901 are coated with green (G) phosphors, and the cylindrical sidewalls of the holes 902 arranged in a direction 907 in the rib 901 are coated with blue (B) phosphors. The cylindrical sidewalls coated with R, G and B form R, G and B cells, respectively. A trio of adjacent R, G and B cells forms one pixel.

The Y electrodes 801 and X electrodes 802 are supplied with drive voltages from the Y driving circuit 803 and the X driving circuit 804, respectively. One field of 1/60 seconds forming one picture is divided into 10 subfields for producing gray scale representation. One subfield comprises a reset period, an address period and a sustain period as in the case of a conventional driving. In Embodiment 3, the address discharge during the address period is generated between the X and Y electrodes, the Y electrodes perform the same function as in the case of the conventional driving, and the X electrodes perform the function of addressing in addition to the function of the conventional X electrodes.

The voltage waveforms Vsx and Vsy applied to the X and Y electrodes, respectively, during the sustain period can be the same as those shown in FIG. 1 or FIG. 7.

With the above voltages applied, a pre-discharge 1 is generated between the sustain electrodes during the pre-discharge period Tp, and thereafter a main discharge 2 is generated in the sustain-pulse-applied period Ts. It was confirmed that luminous efficacy is improved by producing the sustain discharges following the pre-discharges compared with that obtained by conventional discharges without the pre-discharges.

In a case where the sustain pulse repetition period is in a range of from 4 μs to 13 μs, or in a range of from 6 μs to 13 μs, Vpmin is defined as the pre-discharge voltage Vp capable of stabilizing the two-step discharge, and Vpmin is selected to satisfy the following formulas:

$$Vp\min \leqq Vp,\ Vp\min = 2\ Vs\min - Vs - \alpha.$$

Embodiment 3 employing the ac two-electrode vertical-discharge and the box-rib structure is less susceptible to the crosstalk-induced unwanted discharges, and therefore Embodiment 3 is less subject to discharge instability due to the unwanted discharges than the box-rib structure in Embodiment 2.

In a case where a PDP having a discharge gas of Ne—Xe 5% and 500 Torr sealed therein was driven by using a conventional sustain waveform having the sustain pulse repetition period of 7 μs and the pre-discharge period Tp of 0.7 μs, Vsmin turned out to be 180 V.

Figure 21:
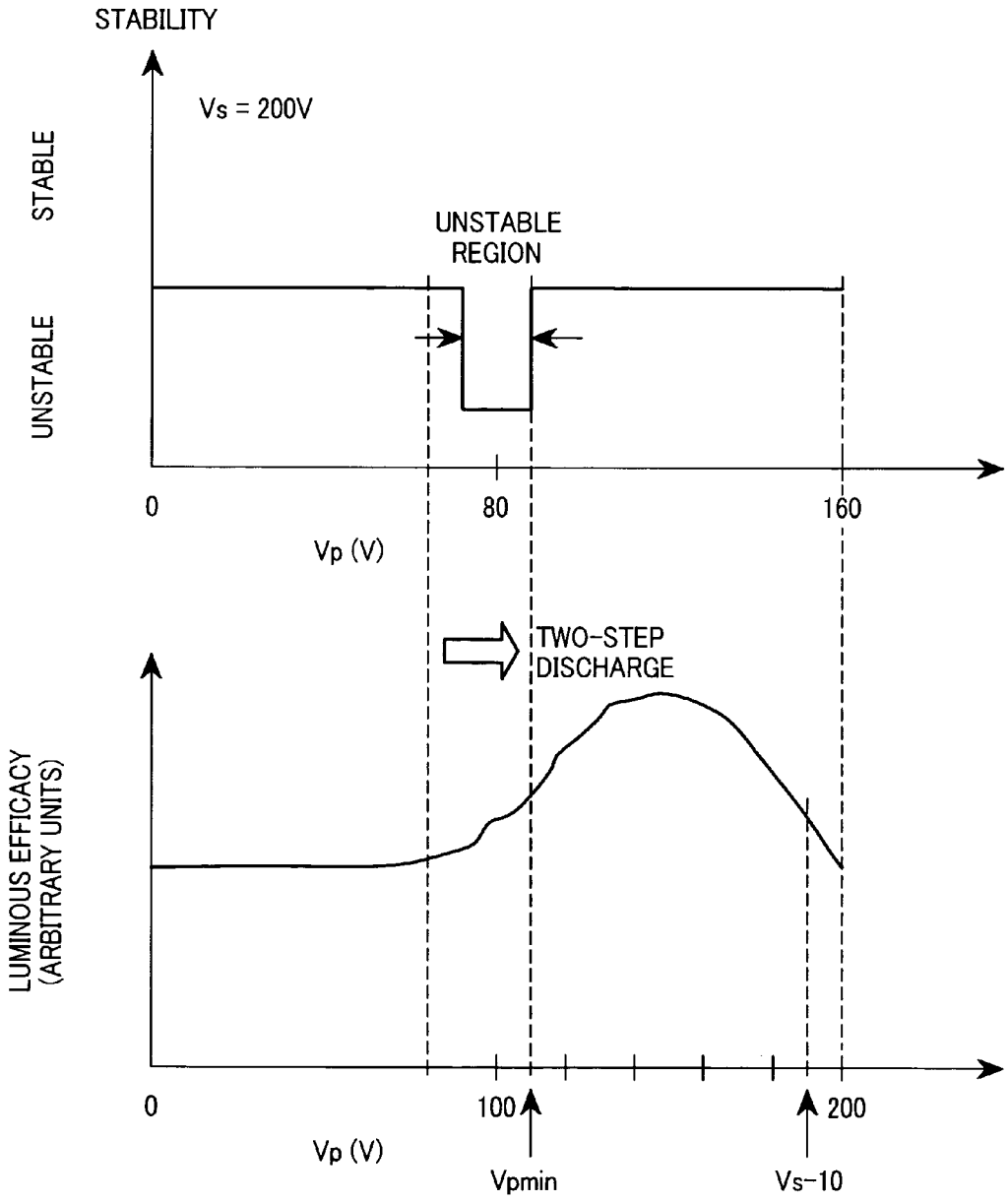
FIG. 21 is a graph showing discharge stability and a pre-discharge-voltage Vp dependency of luminous efficacy for a case where the two-step discharge driving waveform shown in FIG. 1 was employed as a sustain waveform.

FIG. 21 is a graph showing discharge stability and a pre-discharge voltage Vp dependency of luminous efficacy for a case where the two-step discharge driving waveform shown in FIG. 1 was employed as a sustain waveform, and the sustain voltage Vs is selected to be 200 V. In FIG. 21, Vpmin is 110 V. By using Vsmin and Vs, there is obtained, $$\begin{aligned} Vpmin &= 2\ Vsmin - Vs - \alpha \\ &= 2 \times 180 - 200 - \alpha \\ &= 160 - 50. \end{aligned}$$

Solving for α gives

α=50 V.

To sum up, the stable two-step discharge can be obtained by selecting Vp to satisfy the following formulas:

$$Vp\min \leqq Vp < Vs,\ Vp\min = 2\ Vs\min - Vs - 50.$$

Further, for the purpose of further reducing or suppressing the decreasing of lifetime of the protective films, image sticking and others, and improving the luminous efficacy, it is desirable to satisfy the following:

$$Vp < Vs - 10.$$

With the above-explained configuration, since the pre-discharge is generated in a state of the low discharge-space voltage during the pre-discharge period in which Vp is applied, advantages are provided which are capable of lengthening the lifetime of the protective films and reducing or suppressing image sticking.

As explained above, since the driving method and conditions in accordance with the present invention can lower the discharge-space voltages at the start of sustain discharges and in the former half of the sustain discharges, the lifetime of the protective films can be lengthened and the protective-film-induced image sticking can be reduced.

Especially when the above-explained driving is employed for the PDP having its required driving voltage increased because of the increased partial pressure of Xe in the discharge gas (the partial pressure of Xe being selected to be in a range of from 6.5% to 50%), even if the driving voltage is increased, the increase in the discharge-space voltage can be suppressed. Consequently, the decreasing of lifetime of the protective films can be prevented.

It is needless to say that all the possible combinations of the above-explained embodiments and examples can be realized as the present invention.

Although the present invention has been explained concretely based on the above embodiments and examples, it is needless to say that the present invention is not limited to the above-explained embodiments and examples, various changes and modifications may be made to those without departing from the spirit of the invention.

What is claimed is:

1. A plasma display device comprising:

a plasma display panel provided with at least a plurality of discharge cells each having at least discharge gas, a pair of sustain electrodes which generate sustain discharge for light-emission display, and a phosphor which generates visible light by being excited by ultraviolet rays generated by said sustain discharge; and a driving circuit which applies a sustain pulse voltage between said pair of sustain electrodes for generating said sustain discharge;

wherein said sustain pulse voltage is comprised of a first portion having a main portion of a first voltage Vp V and a second portion succeeding said first portion in time and having a main portion of a second voltage Vs V higher than said first voltage Vp V, said sustain discharge is comprised of a pre-discharge and a main discharge succeeding said pre-discharge in time, and said first voltage Vp V is selected to satisfy the following inequality:

$$Vpmin \leqq Vp < Vs,$$

where Vpmin V is a minimum of said first voltage Vp V which stabilizes said sustain discharge; and wherein a load factor is defined as a ratio of a number of lighted cells among said plurality of discharge cells at a given point of time to a total number of said plurality of discharge cells, a pre-discharge ratio is defined as a ratio of an integral of a waveform of a discharge current integrated over a time of said pre-discharge to an integral of a waveform of a discharge current generated by one sustain pulse voltage in said sustain discharge, and when said load factor of a display is smaller, said first voltage Vp V and said second voltage Vs V are selected to make said pre-discharge ratio greater than that when said load factor of a display is larger.

2. The plasma display device according to claim 1, wherein said discharge gas contains xenon of a concentration in a range of from 6.5% to 50%.

3. The plasma display device according to claim 2, wherein said first voltage Vp V is selected to also satisfy the following inequality:

$$Vpmin \leqq Vp < Vs - 10,$$

where Vpmin is a minimum of said first voltage Vp V which stabilizes said sustain discharge.

4. The plasma display device according to claim 1, wherein said sustain pulse voltage includes a portion having a pulse repetition period in a range of from 4 μs to 13 μs.

5. The plasma display device according to claim 1, wherein said sustain pulse voltage includes a portion having a pulse repetition period in a range of from 6 μs to 13 μs.

6. The plasma display device according to claim 1, wherein a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vpmin = 2\ Vsmin - Vs - 50.$$

7. The plasma display device according to claim 1, wherein said plurality of sustain electrodes forming said plurality of discharge cells extend in a first direction, and are arranged at equal intervals in a second direction intersecting said first direction, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vpmin = 2\ Vsmin - Vs - 10.$$

8. The plasma display device according to claim 1, wherein said plurality of sustain electrodes forming said plurality of discharge cells extend in a first direction, and are arranged at equal intervals in a second direction intersecting said first direction, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vpmin = 2\ Vsmin - Vs - 35.$$

9. The plasma display device according to claim 1, wherein said plurality of sustain electrodes forming said plurality of discharge cells extend in a first direction, and are arranged in a second direction intersecting said first direction such that a spacing between two adjacent pairs of sustain electrodes is larger than a spacing between two sustain electrodes forming one of said two adjacent pairs, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-25.$$

10. The plasma display device according to claim 2, wherein said sustain pulse voltage includes a portion having a pulse repetition period in a range of from 4 μs to 13 μs.

11. The plasma display device according to claim 2, wherein said sustain pulse voltage includes a portion having a pulse repetition period in a range of from 6 μs to 13 μs.

12. The plasma display device according to claim 3, wherein said sustain pulse voltage includes a portion having a pulse repetition period in a range of from 4 μs to 13 μs.

13. The plasma display device according to claim 3, wherein said sustain pulse voltage includes a portion having a pulse repetition period in a range of from 6 μs to 13 μs.

14. The plasma display device according to claim 3, wherein a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-50.$$

15. The plasma display device according to claim 3, wherein said plurality of sustain electrodes forming said plurality of discharge cells extend in a first direction, and are arranged at equal intervals in a second direction intersecting said first direction, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-10.$$

16. The plasma display device according to claim 3, wherein said plurality of sustain electrodes forming said plurality of discharge cells extend in a first direction, and are arranged at equal intervals in a second direction intersecting said first direction, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-35.$$

17. The plasma display device according to claim 3, wherein said plurality of sustain electrodes forming said plurality of discharge cells extend in a first direction, and are arranged in a second direction intersecting said first direction such that a spacing between two adjacent pairs of sustain electrodes is larger than a spacing between two sustain electrodes forming one of said two adjacent pairs, said plasma display panel is provided with a plurality of rib-like members which extend in said second direction and which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-25.$$

18. The plasma display device according to claim 1, wherein said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-45.$$

19. The plasma display device according to claim 1, wherein said pair of sustain electrodes are arranged to face each other in a direction perpendicular to major surfaces of said sustain electrodes, said plasma display panel is provided with a box-like rib member which separate said plurality of discharge cells from each other, a load factor is defined as a ratio of a number of lighted cells among said plurality of discharge cells at a given point of time to a total number of said plurality of discharge cells, Vsmin V is defined as a minimum of a voltage which can maintain said sustain discharge stably when said load factor is greatest, and Vpmin V satisfies the following equation:

$$Vp\min=2\ Vs\min-Vs-50.$$

* * * * *